United States Patent [19]

Gaut

[11] 4,018,275

[45] Apr. 19, 1977

[54] ANCHORING DEVICE FOR WELL TOOLS

[76] Inventor: Robert T. Gaut, 2730 NW. 31st St., Oklahoma City, Okla. 73112

[22] Filed: May 12, 1976

[21] Appl. No.: 685,496

[52] U.S. Cl. ..... 166/137; 166/139; 166/217

[51] Int. Cl.[2] ..... E21B 23/00

[58] Field of Search ..... 166/137, 139, 140, 216, 166/217

[56] References Cited

UNITED STATES PATENTS

| | | | |
|---|---|---|---|
| 2,871,947 | 2/1959 | Fredd | 166/214 |
| 3,130,788 | 4/1964 | Cochran et al. | 166/217 |
| 3,507,329 | 4/1970 | Stone, Jr. | 166/217 |
| 3,789,925 | 2/1974 | Brown | 166/217 |
| 3,856,081 | 12/1974 | Canalizo | 166/217 |

*Primary Examiner*—James A. Leppink
*Attorney, Agent, or Firm*—Laney, Dougherty, Hessin & Fish

[57] ABSTRACT

An improved anchoring device for well tools including installing and actuating apparatus for providing visual indication at the ground surface verifying proper latching and locking of the device in a casing string. The anchoring device includes a tubular housing assembly, a packer cup assembly secured to the lower portion of the housing assembly, an expansion sleeve slidably disposed within the housing assembly for forcing latching dogs radially outwardly from the housing assembly to engage an annular recess in the casing string, a setting sleeve longitudinally slidably disposed within the housing assembly telescopically related to the expansion sleeve and a lock sleeve releasably secured to the setting sleeve and telescopically related to the expansion sleeve. Three sets of cam-actuated dogs carried by the expansion sleeve react to the relative longitudinal displacement between the expansion sleeve, setting sleeve and lock sleeve to transfer upward force applied by a wire line to latch the anchoring device in the casing string, lock the device in the latched position and actuate the installing and actuating tool to positively indicate whether or not the anchoring device has been properly latched and locked in the casing string. Additional attachments are disclosed for use with the installing and actuating tool to adapt it for releasing and retrieving a properly or improperly latched and locked anchoring device from the casing string.

14 Claims, 20 Drawing Figures

ANCHORING DEVICE FOR WELL TOOLS

BACKGROUND OF THE INVENTION

1. Field of the Invention

The invention relates generally to anchoring devices for well tools and, more particularly, but not by way of limitation, to anchoring devices especially adapted for securing various well tools within a string of well pipe or casing at preselected levels therein in such a manner that the proper installation of the anchoring device may be visually verified at the ground surface and the tools may be released and withdrawn from the well pipe or casing when desired.

2. Description of the Prior Art

The prior art includes various forms of anchoring and landing devices for use in installing tools in a pipe or casing string. A typical form of prior art anchoring and landing device includes a locator tool and and a latching collar or landing nipple placed in the pipe or casing string to establish a place to land an anchoring device. Such apparatus requires a set of latch elements variously called dogs or slips, on the anchoring device with a configuration which will correspond to the configuration of grooves or recesses formed in the landing nipple. When the locator tool is run into a well pipe, such as a tubing string, on a wire line, the tool will pass all collar recesses and other interruptions in the smooth bore of the tubing string, but when the tool comes to a recess in a landing nipple having a configuration matching that of the latch elements, the locator will project into the recess and anchor the tool at this point. Frequently several such tools must be landed in a tubing string and in order to accomplish this, sets of matching configurations for the latch elements and landing nipple recesses are required to selectively set the tools in the proper positions. Each landing nipple must have a configuration peculiar to the latches on the particular tool to be landed therein.

U.S. Pat. No. 3,130,788, to C. B. Cochran et al., discloses an anchoring device for well tools intended to provide improvements in economy and simplification over the apparatus described above. The Cochran apparatus employs a single set of latch elements and landing nipples having recesses of uniform configuration. This anchoring device is capable of being set in any one of a plurality of like landing nipples in a pipe string, and includes means for attaching the anchoring device to a wire line by which it could be run into the hole and for releasing the wire line from the anchoring device automatically when the tool is anchored.

It has been found, however, that apparatus such as that disclosed in the Cochran patent, adapted to be run and set on a wire line, are often unreliable due to improper setting of the anchoring device in the pipe string without the knowledge of the operator at the ground surface. Improper setting of such anchoring devices is extremely disadvantageous and hazardous under conditions where the anchoring device and tool mounted thereon must withstand relatively high pressures acting thereon from within the well such as in gas wells. Accordingly, it will be readily apparent that it is most advantageous to verify, at the ground surface, that an anchoring device for well tools has been properly latched and locked in a pipe or casing string before additional operations are conducted on a well in reliance on such device.

SUMMARY OF THE INVENTION

The present invention contemplates an anchoring device anchorable in a selected one of any number of recesses formed within a pipe string or the like. The present invention includes a tubular body insertable in the interior of a pipe string with an expansion sleeve disposed therein for longitudinal movement relative thereto and with setting sleeve means disposed therein in longitudinal telescopic relation with the expansion sleeve means for longitudinal movement relative to the tubular body and to the expansion sleeve means. The tubular body also houses lock sleeve means therein releasably securable to the setting sleeve means and in longitudinal telescopic relation with the expansion sleeve means for longitudinal movement relative to the tubular body and to the expansion sleeve means. The invention further includes biasing means operatively engaging the lock sleeve means and the setting sleeve means for urging the lock sleeve means longitudinally toward the expansion sleeve means, and retainer means releasably securing the lock sleeve means to the setting sleeve means against the urging of the biasing means with the retainer means being releasable in response to predetermined longitudinal movement of the setting sleeve means relative to the tubular body. The tubular body includes at least one opening formed in the wall thereof with anchor member means disposed in the at least one opening for moving radially into and out of the recesses in the pipe string, with inwardly projecting shoulder means formed on the anchor member means. Outwardly projecting enlargement means are formed on the expansion sleeve means movable therewith relative to the anchor member means between positions in and out of registration with the shoulder means for displacing the anchor member means radially outwardly into the recesses to anchor the device and for releasing the anchor member means to permit radially inward retraction thereof from the recesses in response to longitudinal movement of the expansion sleeve means relative to the tubular body.

The anchoring device further includes latch member means carried by the expansion sleeve means and operatively engaging the setting sleeve means and tubular body for latching the expansion sleeve means in position maintaining the anchoring member means in the recesses in response to longitudinal movement of the setting sleeve means relative to the expansion sleeve means; lock member means carried by the expansion sleeve means and operatively engaging the setting sleeve means and the lock sleeve means for locking the expansion sleeve means in position maintaining the anchor member means in the recesses and preventing longitudinal movement thereof relative to the tubular body in response to longitudinal movement of the setting sleeve means relative to the expansion sleeve means and to the release of the retainer means and longitudinal movement of the lock sleeve means relative to the expansion sleeve means under the urging of the biasing means; and verification member means carried by the expansion sleeve means and operatively engaging the setting sleeve means and the lock sleeve means for verifying the completion of the locking of the expansion sleeve means in position maintaining the anchor means in the recesses in response to additional longitudinal movement of the setting sleeve means relative to the expansion sleeve means.

The invention further includes actuating means insertable in the interior of a pipe string from the ground surface for releasably engaging the setting sleeve means and expansion sleeve means and applying upward longitudinal movement thereto relative to the tubular body to anchor the anchoring device in a selected one of the recesses. The invention also includes retrieving means insertable in the interior of the pipe string from the ground surface for releasably engaging the anchored anchoring device in the pipe string, releasing the anchor member means from the pipe string and retrieving the anchoring device from the pipe string.

An object of the present invention is to provide an anchoring device for well tools which is economical and reliable in operation.

Another object of the present invention is to provide an anchoring device for well tools including installing an actuating structure to provide visual verification of the proper latching and locking of the anchoring device in the casing string or the like.

An additional object of the present invention is to provide an anchoring device for well tools which can be inserted or retrieved using conventional wire line equipment, and a lubricator at the wellhead, thus eliminating the necessity for costly killing of the well with fluids during the inserting and retrieving operations and possible damage to the well from such fluids.

Another object of the present invention is to provide an anchoring device for well tools which, when properly latched, locked and verified, can only be released by the retrieving tool thus preventing unintentional release by the installing tool or any other well tools which may be used.

A further object of the present invention is to provide reliable and simple apparatus for releasing and retrieving both properly and improperly anchored anchoring devices from the casing string or the like.

Other objects and advantages of the invention will be evident from the following detailed description when read in conjunction with the accompanying drawings.

DESCRIPTION OF THE PREFERRED EMBODIMENT

Figure 1A:
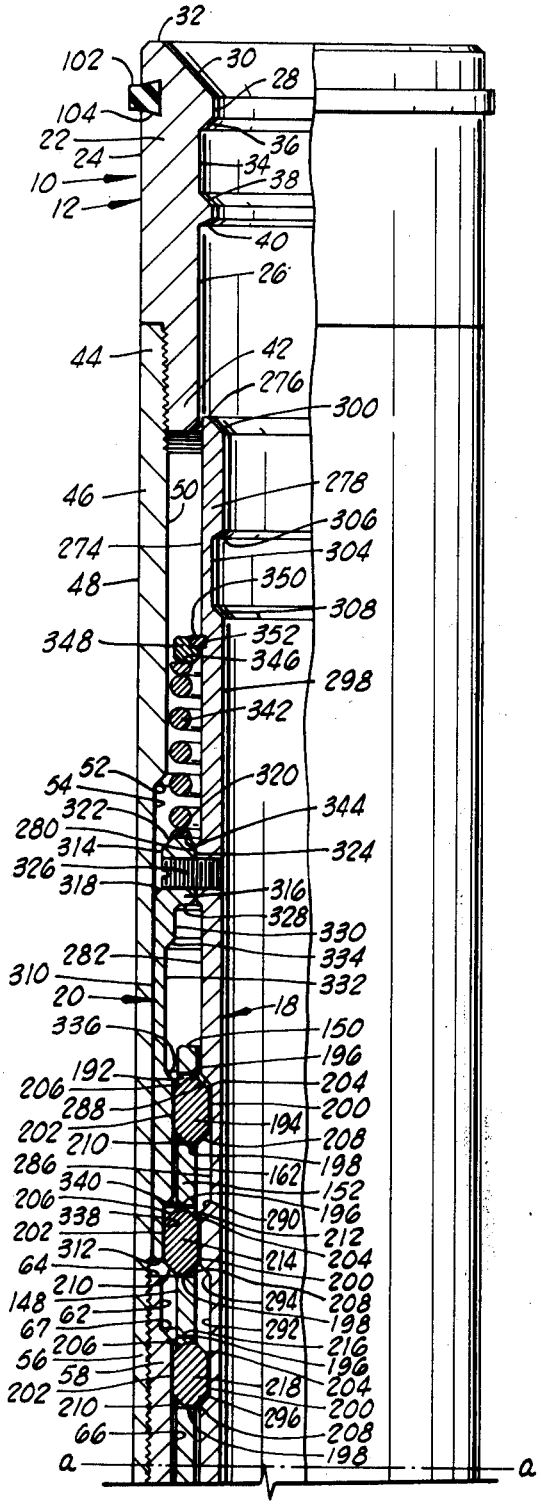
FIGS. 1A and 1B, joined alone line *a—a*, provide a partial vertical cross-sectional view illustrating an anchoring device and packer constructed in accordance with the present invention.
Figure 1B:
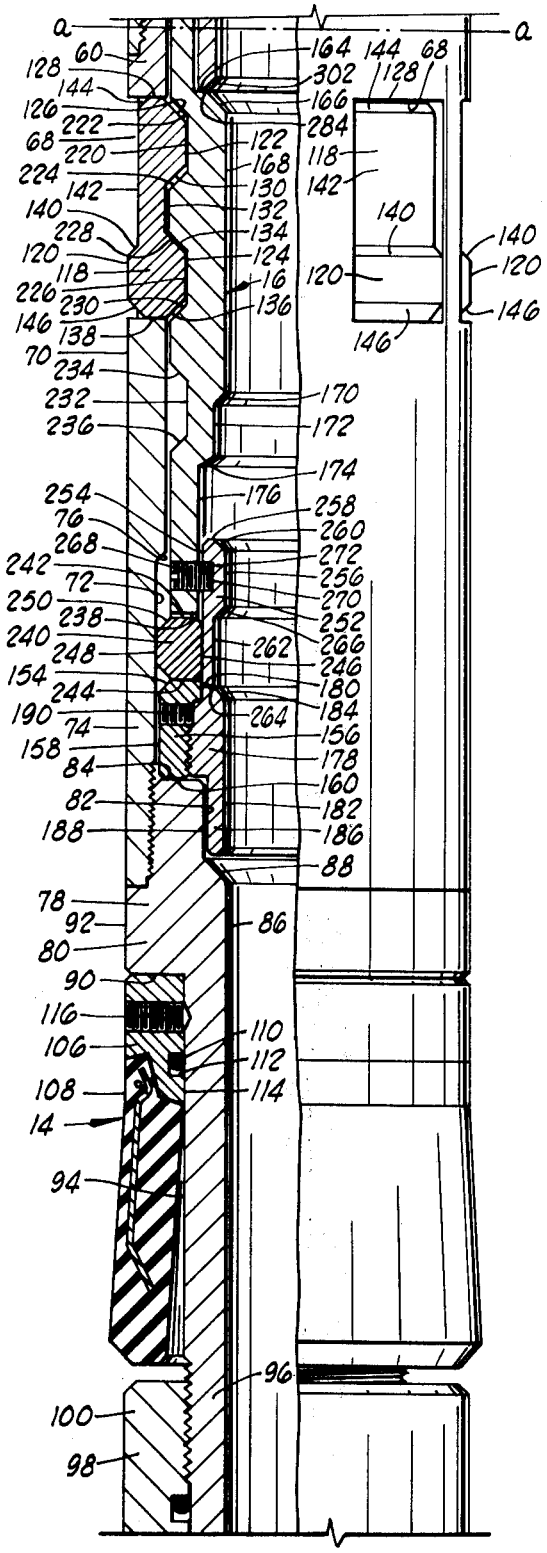
Figure 2A:
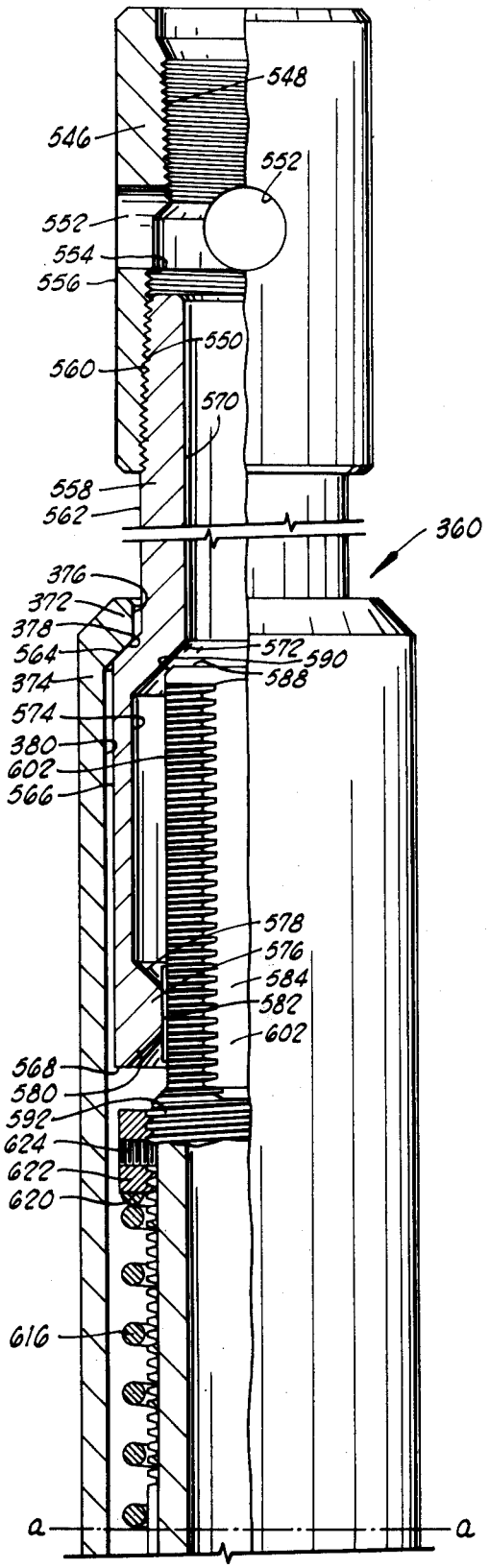
FIGS. 2A, 2B, 2C and 2D, joined respectively along lines *a—a*, *b—b* and *c—c*, provide a partial vertical cross-sectional view illustrating an installing and actuating tool employed with the apparatus of FIGS. 1A and 1B.
Figure 2B:
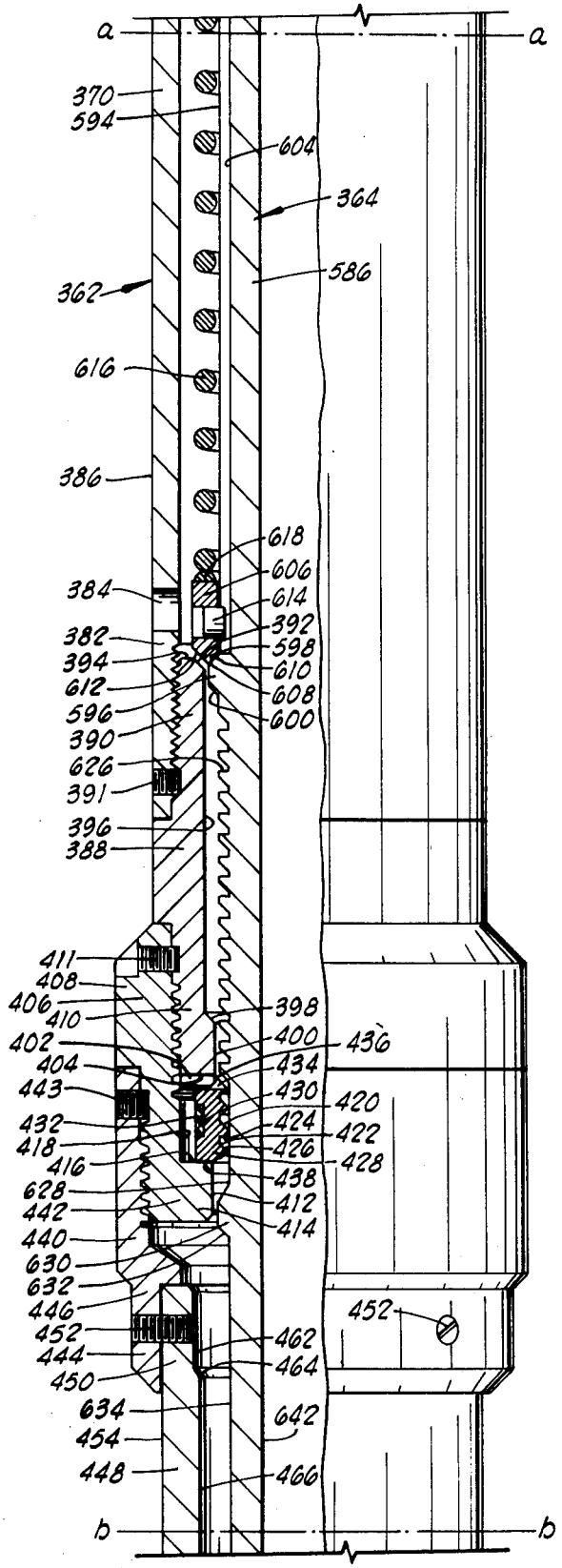
Figure 2C:
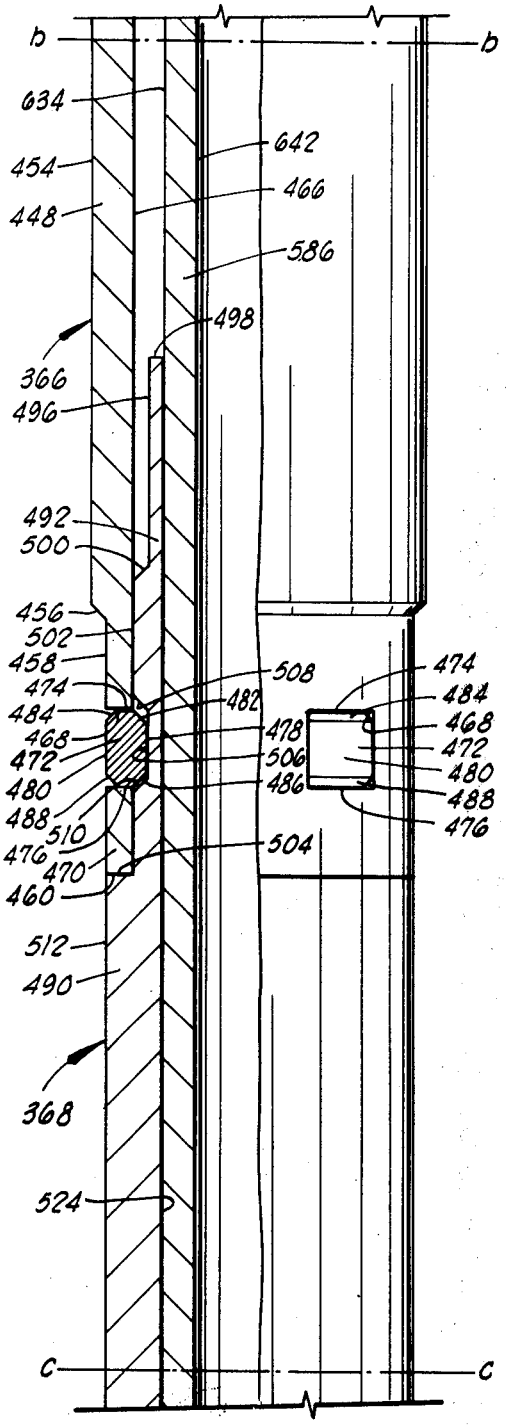
Figure 2D:
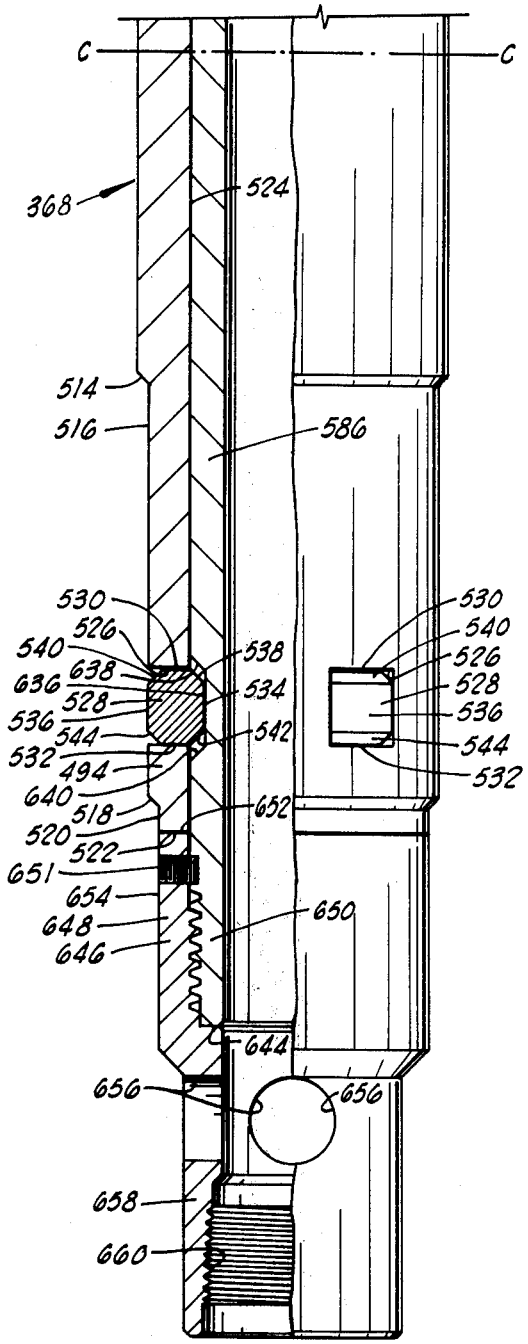

Referring now to the drawings, and to FIGS. 1A and 1B in particular, an anchoring device adapted for securing various well tools within a string of well pipe or casing at preselected levels therein is designated by the reference character 10. The anchoring device 10 comprises a tubular housing assembly 12, a casing or pipe packer cup assembly 14 secured to the lower portion of the tubular housing assembly 12, a tubular expansion sleeve 16 longitudinally slidably disposed within the tubular housing assembly 12, a tubular setting sleeve 18 longitudinally slidably disposed within the tubular housing assembly 12 and in sliding telescopic relation with the expansion sleeve 16 and a tubular lock sleeve 20 releasably secured to the setting sleeve 18 and in longitudinal telescopic relation with the expansion sleeve 16.

The tubular housing assembly 12 includes a tubular top member 22 having a cylindrically shaped outer periphery 24 and a cylindrically shaped inner surface 26. A radially inwardly extending annular rib 28 is formed in the top member 22 intermediate the inner surface 26 and a tapered annular shoulder 30 communicating between the rib 28 and the upper end face 32 of the top member. An annular recess 34 is formed in the annular rib 28 and includes tapered upper and lower annular shoulders 36 and 38 communicating with the inner cylindrical surface of the rib 28. An annular shoulder 40 extends between the inner surface 26 and the inner surface of the annular rib 28.

The lower end portion 42 of the top member 22 is threadedly secured to the upper end portion 44 of the tubular lock mechanism housing member 46. The housing member 46 has a cylindrical outer periphery 48 and a cylindrical upper inner surface 50. An annular shoulder 52 extends between the upper inner surface 50 and a cylindrical lower inner surface 54 having a diameter greater than the diameter of the upper inner surface 50.

The lower end portion 56 of the housing member 46 is threadedly secured to the upper end portion 58 of a tubular latch mechanism housing member 60. The housing member 60 includes a first cylindrical inner surface 62 extending downwardly from the upper end face 64 and communicating with a second cylindrical inner surface 66 via a tapered annular shoulder 67. The diameter of the second cylindrical inner surface 66 is less than the diameter of the first cylindrical inner surface 62. A plurality of radially aligned, circumferentially spaced windows or openings 68 formed in the housing member 60 and extend between the second cylindrical inner surface 66 and the cylindrical outer periphery 70 thereof. A third cylindrical inner surface 72, having a diameter greater than the diameter of the second cylindrical inner surface 66, is formed in the lower end portion 74 of the housing member 60 and communicates with the second cylindrical inner surface 66 via a tapered annular shoulder 76.

Figure 12A:
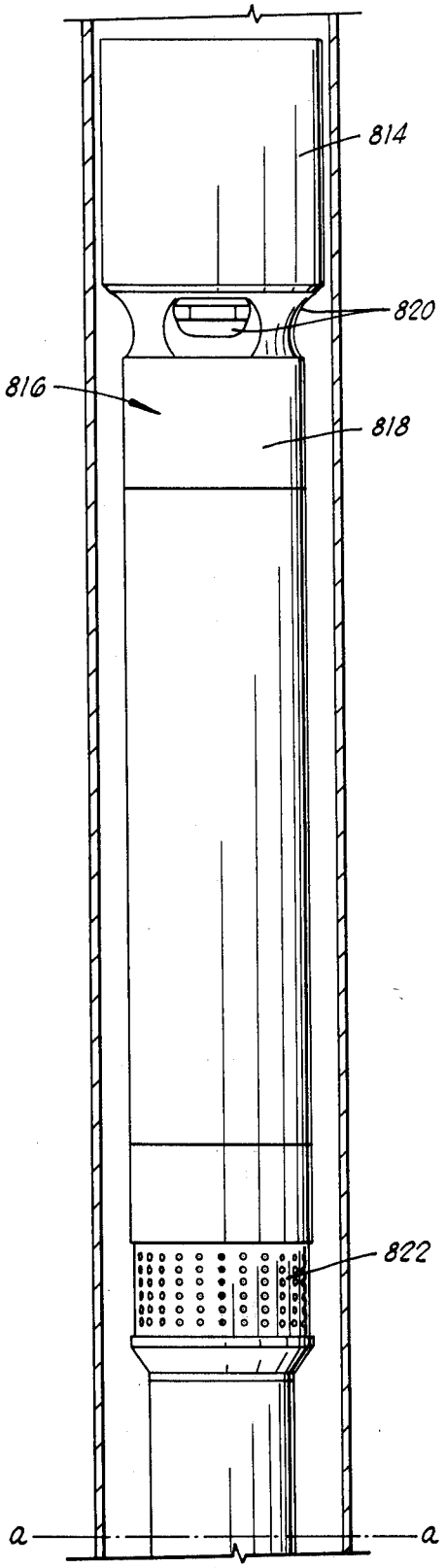
FIGS. 12A and 12B, joined along section line *a—a*, provide an elevational view illustrating an alternate form of anchoring device employing a safety valve therein.
Figure 12B:
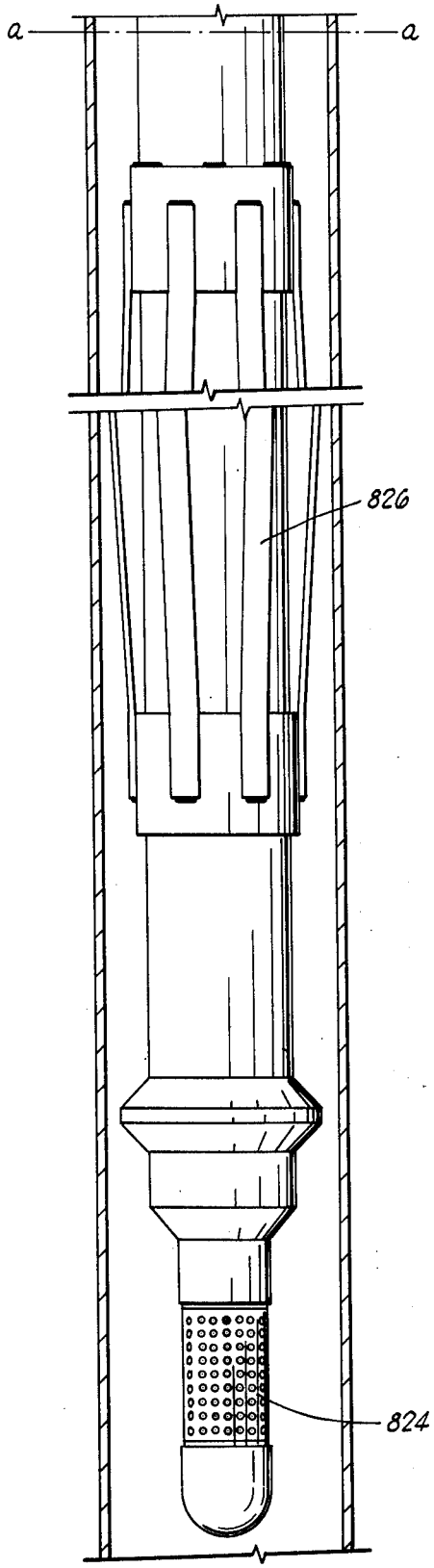

The lower end portion 74 of the housing member 60 is threadedly secured to the upper end portion 78 of a tubular packer support housing member 80. The housing member 80 includes a first cylindrical inner surface 82 extending downwardly from the upper end face 84 of the housing member 80, and a second cylindrical inner surface 86, having a diameter less than the diameter of the first cylindrical inner surface 82 and communicating therewith via a tapered annular shoulder 88. A radial circumferential shoulder 90 extends inwardly from the upper cylindrical outer periphery 92 of the housing member 80. A lower cylindrical outer surface 94 communicates with the circumferential shoulder 90 and extends downwardly therefrom to the lower end portion 96 of the housing member 80. The lower end portion 96 of the housing member 80 is threadedly secured to a bottom nut 98 having a cylindrical outer periphery 100 with a diameter substantially equal to the diameter of the cylindrical outer periphery 92 of the housing member 80. It will be understood that various forms of adapters may be employed in lieu of the bottom nut 98 for securing other forms of tools to the lower end portion 96 of the housing member 80. As an example, an adapter may be secured to the lower end portion 96 to mount a safety valve on the lower portion of the anchoring device 10 as illustrated in FIGS. 12A and 12B and as will be described more fully hereinafter.

A resilient annular dust seal 102 is preferably mounted in a circumferential groove 104 formed in the cylindrical outer periphery 24 of the top member 22 adjacent the upper end face 32 thereof. The annular dust seal may be suitably formed of an elastomeric material or a synthetic resin material.

The casing packer assembly 14 is disposed about the packer support housing member 80 intermediate the annular shoulder 90 thereof and the bottom nut 98. The casing packer assembly 14 is of commercially available, conventional construction and comprises a metallic packer mounting ring 106 and a spring-reinforced resilient elastomeric packer cup 108 secured to and extending downwardly from the packer mounting ring 106. A fluid-tight seal is achieved between the packer mounting ring 106 and the outer surface 94 of the housing member 80 by means of a suitable annular sealing member 110, such as an elastomeric O-ring, disposed in an annular groove 112 formed in the inner periphery 114 of the mounting ring 106. A plurality of set screws 116 are employed to secure the mounting ring 106 to the housing member 80 in abutting relation with the annular shoulder 90.

A recess engaging dog or slip 118 is received in each opening 68 of the latch mechanism housing member 60 and is adapted for radial movement therein. Radially outward movement of each dog 118 is positively limited by ears (not shown) formed thereon which are engageable with the housing member 60 adjacent the respective opening 68 in which the dog is received. Each dog 118 includes a radially outwardly extending shoulder 120 formed thereon for engagement in a suitable annular recess in a pipe or casing string. A pair of radially inwardly extending shoulders 122 and 124 are formed on each recess engaging dog 118. Each recess engaging dog 118 includes an upwardly and outwardly inclined surface 126 extending from the shoulder 122 to the upper end face 128 thereof. A downwardly and outwardly inclined surface 130 extends from the inwardly extending shoulder 122 to a vertical surface 132. An upwardly and outwardly inclined surface 134 extends from the inwardly extending shoulder 124 to the vertical surface 132. A downwardly and outwardly inclined surface 136 extends from the inwardly extending shoulder 124 to the lower end face 138 of each engaging dog 118.

Each recess engaging dog 118 further includes an upwardly and inwardly extending inclined surface 140 communicating between the outwardly extending shoulder 120 and a vertical surface 142. The vertical surface 142 communicates with the upper end face 128 via an inclined surface 144. A downwardly and inwardly inclined surface 146 extends between the outwardly extending shoulder 120 and the lower end face 128 of each recess engaging dog 118.

It will be understood that the exterior configuration of the recess engaging dogs 118 may be modified for various applications of the anchoring device 10 to correspond to the configuration of the annular recess within a pipe or casing string in which the device is to be anchored.

The expansion sleeve 16 is longitudinally slidably disposed within the lock mechanism housing member 46, and the latch mechanism housing member 60 of the tubular housing assembly 12. The expansion sleeve 16 includes a first substantially cylindrical outer surface 148 which extends downwardly from the upper end face 150 of the upper end portion 152 and communicates with a circumferential shoulder 154 formed on the lower end portion 156 of the expansion sleeve 16. The circumferential shoulder 154 communicates with a second cylindrical outer surface 158 which, in turn, communicates with the lower end face 160 of the lower end portion 156 of the expansion sleeve 16. The diameter of the cylindrical outer surface 148 is slightly less than the diameter of the second cylindrical inner surface 66 of the latch mechanism housing member 60 and the diameter of the second cylindrical outer surface 158 is slightly less than the diameter of the third cylindrical inner surface 72 of the housing member 60 to permit free longitudinal sliding movement of the expansion sleeve 16 within the housing assembly 12.

A first cylindrical inner surface 162 extends downwardly from the upper end face 150 and communicates with a radially inwardly extending annular shoulder 164 which in turn communicates with a tapered annular shoulder 166. The tapered annular shoulder 166 communicates with a second cylindrical inner surface 168 which extends downwardly to communicate with a second tapered annular shoulder 170 which communicates with a third cylindrical inner surface 172. An annular shoulder 174 extends radially outwardly from the third cylindrical inner surface 172 and communicates with a fourth cylindrical inner surface 176.

An expansion sleeve bottom nut 178 is threadedly secured to the lower portion 156 of the expansion sleeve 16 and includes an upper end face 180 which communicates with the fourth cylindrical inner surface 176 of the expansion sleeve 16. The upper end face 180 communicates with a cylindrical inner surface 182 via a tapered annular shoulder 184. The bottom nut 178 includes a lower annular skirt portion 186 which extends downwardly from the lower end face 160 of the expansion sleeve 16. The cylindrical outer surface 188 of the skirt portion 186 has a diameter slightly less than the diameter of the first cylindrical inner surface 82 of the packer support housing member 80. The threaded engagement between the bottom nut 178 and the expansion sleeve 16 is preferably maintained by a suitable lock screw 190.

A plurality of radially aligned, circumferentially spaced lock verification windows or openings 192 are formed in the upper end portion 152 of the expansion sleeve 16 adjacent the upper end face 150 thereof and extend between the inner and outer cylindrical surfaces 162 and 148. The number of openings 192 formed in the expansion sleeve 16 will vary depending upon the diameter of the expansion sleeve 16, however, it is considered desirable to include at least four openings 192 in the expansion sleeve 16. A lock verification dog 194 is received in each opening 192 of the expansion sleeve 16 and is adapted for radial movement therein. Each lock verification dog 194 includes an upper end face 196, a lower end face 198, a vertical inner surface 200 and a vertical outer surface 202. Inclined surfaces 204 and 206 communicate respectively between the upper end face 196 and the inner and outer surfaces 200 and 202. Inclined surfaces 208 and 210 communicate respectively between the lower end face 198 and the inner and outer surfaces 200 and 202.

A plurality of radially aligned, circumferentially spaced lock windows or openings 212 are formed in the upper end portion 152 of the expansion sleeve 16 and also extend between the inner and outer surfaces 162 and 148 of the housing assembly. The openings 212 are positioned a short distance longitudinally downwardly from the openings 192. The number and arrangement of the openings 212 is substantially identical to the number and arrangement of the openings 192 for a particular diameter of expansion sleeve. A lock dog 214 is received in each opening 212 and is adapted for radial movement therein. The lock dogs 214 are identical in configuration to the lock verification dogs 194 and, therefore, the corresponding surfaces thereof will be given the identical reference characters applied to the lock verification dogs 194. No additional detailed description of the lock dogs 214 is deemed necessary.

A plurality of radially aligned, circumferentially spaced latch windows or openings 216 are formed in the upper end portion 152 of the expansion sleeve 16 and also extend between the inner and outer cylindrical surfaces 162 and 148 thereof. The number and arrangement of the latch windows 216 is identical to the number and arrangement of lock verification windows 192 for a given diameter of expansion sleeve 16. The latch windows 216 are spaced a distance longitudinally downwardly from the lock windows 212. A latch dog 218 is received in each window or openings 216 of the expansion sleeve 16 and is adapted for radial movement therein. The latch dogs 218 are identical in configuration to the lock dogs 214 and the lock verification dogs 194 and, therefore, the corresponding external surfaces thereof will carry the same reference character designation as the lock verification dogs 194. No additional detailed description of the latch dogs 218 is deemed necessary.

It should be noted that the perpendicular distance between the inner and outer surfaces 200 and 202 of each of the dogs 194, 214 and 218 is substantially greater than the wall thickness of the expansion sleeve 16 between the inner and outer surfaces 162 and 148 thereof.

The expansion sleeve 16 further includes a first circumferential recess 220 formed in and communicating with the cylindrical outer surface 148 via upper and lower tapered circumferential shoulders 222 and 224. A second circumferential recess 226 is formed in and communicates with the cylindrical outer surface 148 via upper and lower tapered circumferential shoulders 228 and 230. The second circumferential recess 226 is spaced longitudinally downwardly from the first circumferential recess 220. A third circumferential recess 232 is formed in and communicates with the cylindrical outer surface 148 via upper and lower tapered circumferential shoulders 234 and 236. The third circumferential recess 232 is spaced a distance longitudinally downwardly from the second circumferential recess 226. Circumferential enlargements are formed respectively on the expansion sleeve 16 intermediate circumferential recess 220 and 226 intermediate circumferential recesses 226 and 232.

A plurality of radially aligned, circumferentially spaced release windows or openings 238 are formed in the lower end portion 156 of the expansion sleeve 16 adjacent the circumferential shoulder 154 and extend between the fourth cylindrical inner surface 176 and the cylindrical outer surface 148 of the expansion sleeve 16. The number and arrangement of the release windows 238 in the expansion sleeve 16 will vary depending upon the diameter of the expansion sleeve, however, it is deemed preferable to include at least four release windows in the expansion sleeve. A release dog or stop member 240 is received in each window or opening 238 and is adapted for radial movement therein. Each release dog 240 includes an upper end face 242, a lower end face 244, a vertical inner surface 246 extending between the upper and lower end faces 242 and 244, and a vertical outer surface 248 communicating with the upper end face 242 via an inclined surface 250.

The release dogs 240 are releasably maintained within the respective release windows 238 with the vertical inner surfaces 246 thereof in substantial alignment with the fourth cylindrical inner surface 176 of the expansion sleeve 16 by means of a tubular release sleeve 252 disposed within the lower end portion 156 of the expansion sleeve 16. The tubular release sleeve 252 includes a cylindrical outer surface 254 having a diameter slightly less than the diameter of the adjacent fourth cylindrical inner surface 176 of the expansion sleeve 16. A first cylindrical inner surface 256 communicates with the upper end face 258 of the release sleeve 252 via a tapered annular shoulder 260. A second cylindrical inner surface 262, having a diameter greater than the diameter of the first cylindrical inner surface 256, communicates with the lower end face 264 and with a tapered annular shoulder 266 which in turn communicates with the first cylindrical inner surface 256. The tubular release sleeve 252 is releasably maintained in position with the lower end face 264 thereof abutting the upper end face 180 of the bottom nut 178 by means of at least one release sleeve shear screw 268 threadedly secured through the wall of the expansion sleeve 16 with the radially inner end 270 thereof received in a corresponding cavity 272 formed in the cylindrical outer surface 254 of the release sleeve 252.

The setting sleeve 18 is longitudinally slidably disposed within the tubular top member 22, the tubular lock mechanism housing member 46 and the tubular latch mechanism housing member 60 of the tubular housing assembly 12. The setting sleeve 18 includes a first cylindrical outer surface 274 which extends downwardly from the upper end face 276 formed on the upper end portion 278 thereof. The cylindrical outer surface 274 communicates at its lower end with a radially outwardly extending circumferential rib 280. The rib 280 communicates with a second cylindrical outer surface 282 which communicates at its lower end with the lower end face 284 of the setting sleeve. A first circumferential recess 286 is formed in the outer surface 282 and communicates therewith via upper and lower tapered circumferential shoulders 288 and 290. A second circumferential recess 292 is formed in the cylindrical outer surface 282 a distance longitudinally downwardly from the first circumferential recess 286 and communicates with the cylindrical outer surface 282 via upper and lower tapered circumferential shoulders 294 and 296.

The setting sleeve 18 further includes a cylindrical inner surface 298 which communicates at its upper end with the upper end face 276 via a tapered annular surface 300 and communicates at its lower end with the lower end face 284 via a tapered annular surface 302. An annular recess 304 is formed in the upper end portion 278 of the setting sleeve 18 communicating with the cylindrical inner surface 298 via upper and lower tapered annular shoulders 306 and 308. The diameter of the second cylindrical outer surface 282 is slightly less than the diameter of the first cylindrical inner surface 162 of the expansion sleeve 16 to permit close sliding relative longitudinal movement between the setting sleeve 18 and the expansion sleeve 16.

The lock sleeve 20 is longitudinally slidably disposed within the lock mechanism housing member 46 of the tubular housing assembly 12. The lock sleeve 20 includes a first cylindrical outer surface 310 which communicates with and extends upwardly from the lower end face 312 thereof. A second cylindrical outer surface 314 is formed in the upper end portion 316 of the lock sleeve 20 and communicates with the cylindrical surface 310 via a circumferential shoulder 318 and communicates with the upper end face 320 thereof via a tapered circumferential surface 322. A radially inwardly extending annular rib 324 is formed on the upper end portion 316 of the lock sleeve 20 and is releasably maintained in contact with the circumferential rib 280 of the setting sleeve 18 by means of one or more shearable setting sleeve shear screws 326 threadedly mutually engaging the setting sleeve 18 and lock sleeve 20. A downwardly facing annular shoulder 328 is formed on the lower side of the annular rib 324 and communicates with a first cylindrical inner surface 330 extending downwardly therefrom. A first annular recess 332 is formed in and communicates with the cylindrical inner surface 330 via upper and lower tapered annular shoulders 334 and 336. A second annular recess 338 is formed in the cylindrical inner surface 330 and communicates therewith via a tapered annular shoulder 340 and further communicates with the lower end face 312. The diameter of the first cylindrical inner surface 330 is slightly greater than the diameter of the cylindrical outer surface 148 of the expansion sleeve 16 to permit longitudinal telescopic relative movement between the lock sleeve 20 and the expansion sleeve 16.

A lock sleeve compression coil spring 342 is disposed about the cylindrical outer surface 274 of the setting sleeve 18. The lower end face 344 of the spring 342 abuts the upper end face 320 of the lock sleeve 20 while the upper end face 346 of the spring 342 abuts a spring retainer or thrust ring 348 disposed about the cylindrical outer surface 274 of the setting sleeve 18. The spring retainer or thrust ring 348 is secured to the setting sleeve 18 by means of a lock or retainer ring 350 received in a circumferential groove 352 formed in the cylindrical outer surface 274 of the setting sleeve 18. As shown in FIG. 1A, the lock sleeve compression coil spring 342 is compressed to provide a predetermined continuous downward biasing force against the lock sleeve 20 relative to the setting sleeve 18 which is resisted by the unsheared setting sleeve shear screws 326.

Referring now to FIGS. 2A, 2B, 2C and 2D, there is shown an installing and actuating tool generally designated by the reference character 360 which is employed in installing or positioning the anchoring device 10 in a string of well pipe or casing and actuating the anchoring device to anchor it at a preselected level therein. The installing and actuating tool 360 comprises a tubular housing assembly 362, an operating mandrel assembly 364, a setting sleeve assembly 366 and a setting gage sleeve assembly 368.

The tubular housing assembly 362 includes a tubular upper housing member 370 having a radially inwardly extending annular flange 372 formed on the upper end portion 374 thereof. The annular flange 372 comprises a cylindrically shaped inner surface 376 and a tapered annular shoulder 378 formed thereon communicating with the inner surface 376. The annular shoulder 378 communicates with a cylindrically shaped inner surface 380 which extends downwardly therefrom to the lower end portion 382 of the upper housing member 370. A pressure equalization port 384 is formed in the wall of the upper housing member 370 communicating between the inner surface 380 and the cylindrical outer periphery 386 of the housing member 370.

The tubular housing assembly 362 further includes a tubular upper housing adapter 388 threadedly secured at the upper end portion 390 thereof to the lower end portion 382 of the upper housing member 370 and locked thereto by a threaded safety lock screw 392 extending through the lower end portion 382 of the upper housing member 370. A tapered annular shoulder 392 is formed on the upper end portion 390 and communicates between the upper end face 394 and the first cylindrical inner surface 396 extending downwardly therefrom. The lower end portion of the cylindrical inner surface 396 communicates with a tapered annular shoulder 398 which in turn communicates with a second cylindrical inner surface 400. A plurality of circumferentially spaced, downwardly extending, radially aligned dogs 402 are formed on the lower end face 404 of the upper housing adapter 388. The lower end face 404 communicates with the cylindrical inner surface 400.

The tubular housing assembly 362 further includes a tubular snap but housing 406 threadedly secured at its upper end portion 408 to the lower end portion 410 of the upper housing adapter 388 and locked thereto by a threaded safety lock screw 411 extending through the snap nut housing 406. The snap nut housing 406 includes a first cylindrical inner surface 412 formed on the lower end portion 414 thereof and having a diameter substantially equal to the diameter of the cylindrical inner surface 400 of the upper housing adapter 388. A radial annular shoulder 416 extends outwardly from the cylindrical inner surface 412 and communicates with a second cylindrical inner surface 418 which extends upwardly therefrom.

The tubular housing assembly 362 further includes an annular, segmented snap nut assembly 420 disposed intermediate the upwardly facing annular shoulder 416 of the snap nut housing 406 and the downwardly facing lower end face 404 of the upper housing adapter 488. The snap nut assembly 420 comprises a plurality of snap nut segments each having a portion of an internal buttress thread 422 formed on the inner surface thereof. The internal buttress thread 422 is characterized by a radially aligned downwardly facing surface 424 and a downwardly and inwardly inclined upwardly facing surface 426. The snap nut assembly 420 preferably includes four nut segments 428 which are freely radially movable between the annular shoulders 416 and 404 and are maintained in annular relation and biased radially inwardly by means of an annular snap nut spring 430 encircling the nut segments 428 and positioned in a recess 432 formed in the outer periphery of each nut segment 428. The downwardly extending dogs 402 of the upper housing adapter 388 are received in corresponding radially aligned grooves 434 formed in the upper end face 436 of each nut segment 438 of the snap nut assembly 420 and the lower end face 438 of the snap nut assembly 420 abuts the annular shoulder 416 of the snap nut housing 406 thereby preventing relative rotation between the snap nut assembly 420 and the upper housing adapter 388.

The setting sleeve assembly 366 comprises a tubular safety shear ring 440 threadedly secured to the lower end portion 442 of the snap nut housing 406 and locked thereto by a threaded lock screw 443 extending through the safety shear ring 440. An annular skirt 444 extends downwardly from the lower end portion 446 of the safety shear ring. The setting sleeve assembly 366 further includes a tubular setting sleeve 448 the upper end portion 450 of which is received within the annular skirt 444 of the safety shear ring 440 and is releasably connected thereto by means of a plurality of shearable safety shear screws 452 providing threaded mutual engagement therebetween. The setting sleeve 448 includes a first cylindrical outer surface 454 which extends downwardly from the upper end portion 450 and communicates with a tapered circumferential shoulder 456. The circumferential shoulder 456 communicates with a second cylindrical outer surface 458 which extends downwardly therefrom and communicates with the lower end face 460 of the setting sleeve 448. The setting sleeve 448 further includes a first cylindrical inner surface 462 formed within the upper end portion 450 thereof communicating with a tapered annular shoulder 464 which annular shoulder in turn communicates with a second cylindrical inner surface 466 extending downwardly therefrom and communicating with the lower end face 460.

The setting sleeve assembly 366 further includes a plurality of radially aligned, circumferentially spaced setting windows or openings 468 which are formed in the lower end portion 470 of the setting sleeve and extend between the second cylindrical outer surface 458 and the second cylindrical inner surface 466 thereof. The number of openings 468 formed in the setting sleeve 448 will vary depending upon the diameter of the setting sleeve, however, it is considered preferable to include at least six openings 468 in the setting sleeve. A setting dog 472 is received in each opening 468 and is adapted for radial movement therein. Radially outward movement of each dog 472 is positively limited by ears (not shown) formed thereon and engageable with the setting sleeve 448 adjacent the respective opening 468 in which the dog is received. Each setting dog 472 includes an upper end face 474, a lower end face 476, a vertical inner surface 478 and a vertical outer surface 480. Inclined surfaces 482 and 484 communicate respectively between the upper end face 474 and the inner and outer surfaces 478 and 480. Inclined surfaces 486 and 488 communicate respectively between the lower end face 476 and the inner and outer surfaces 478 and 480. The perpendicular distance between the inner and outer surfaces 478 and 480 of each of the dogs 472 is substantially greater than the wall thickness of the setting sleeve 448 between the inner and outer surfaces 466 and 458 thereof.

The diameter of the cylindrical outer surface 454 is slightly less than the inner diameter of the annular rib 28 of the tubular housing assembly 12 and substantially greater than the diameter of the cylindrical inner surface 298 of the setting sleeve 18. The diameter of the cylindrical outer surface 458 is slightly less than the diameter of the inner surface 298 of the setting sleeve 18.

The setting gage sleeve assembly 368 includes a tubular setting gage sleeve 490 having an upper end portion 492 and a lower end portion 494. A first cylindrical outer surface 496 is formed on the upper end portion 492 and extends downwardly from the upper end face 498 and communicates with a tapered circumferential shoulder 500. The circumferential shoulder 500 communicates with a second cylindrical outer surface 502 which extends downwardly therefrom and communicates with a radial circumferential shoulder 504. A circumferential recess 506 is formed in the outer surface 502 and communicates therewith via upper and lower tapered circumferential shoulders 508 and 510. A third cylindrical outer surface 512 communicates with and extends downwardly from the circumferential shoulder 504 and communicates with a tapered circumferential shoulder 514 which in turn communicates with a fourth cylindrical outer surface 516 which extends downwardly therefrom. The fourth cylindrical outer surface 516 communicates with a tapered circumferential shoulder 518 which in turn communicates with a fifth cylindrical outer surface 520 formed on the lower end portion 494 of the setting gage sleeve 490 and which communicates with the lower end face 522 thereof. A cylindrical inner surface 524 communicates with and extends between the upper end face 498 and the lower end face 422 of the setting gage sleeve 490.

The setting gage sleeve assembly 368 further includes a plurality of radially aligned, circumferentially spaced setting gage openings or windows 526 formed in the lower end portion 494 of the setting gage sleeve 490 which extend between the inner cylindrical surface 524 and the fourth cylindrical outer surface 516. The number of openings 526 formed in the setting gage sleeve 490 will vary depending upon the diameter of the setting gage sleeve, however, it is considered preferable to include at least six openings 526 in the setting gage sleeve.

A setting gage dog 528 is received in each opening or window 526 and is adapted for radial movement therein. Radially outward movement of each dog 528 is positively limited by ears (not shown) formed thereon and engageable with the setting gage sleeve 490 adjacent the respective opening 526 in which the dog is received. Each setting gage dog 528 includes an upper end face 530, a lower end face 532, a vertical inner surface 534 and a vertical outer surface 536. Inclined surfaces 538 and 540 communicate respectively between the upper end face 530 and the inner and outer surfaces 534 and 536. Inclined surfaces 542 and 544 communicate respectively between the lower end face 532 and the inner and outer surfaces 534 and 536. The perpendicular distance between the inner and outer surfaces 534 and 536 of each of the setting gage dogs 528 is substantially greater than the wall thickness of the lower end portion 494 of the setting gage sleeve 490 between the inner and outer surfaces 524 and 516 thereof.

The operating mandrel assembly 364 comprises a tubular top cross-over 546 having an internally threaded upper portion 548 and an internally threaded lower portion 550. A plurality of radial ports or openings 552 are formed in the medial portion of the top cross-over and communicate between the interior 554 and exterior 556 thereof.

The operating mandrel assembly 364 further includes a tubular top mandrel 558 threaded at its upper end portion 560 within the internally threaded lower portion 550 of the top cross-over 546. A first cylindrical outer surface 562 extends downwardly from the top cross-over and communicates with a tapered circumferential shoulder 564 which in turn communicates with a second cylindrical outer surface 566 extending downwardly therefrom to the lower end face 568 of the top mandrel.

A first cylindrical inner surface 570 extends downwardly from the upper end portion 560 of the top mandrel 558 and communicates with a tapered annular shoulder 572 which in turn communicates with a second cylindrical inner surface 574. The second cylindrical inner surface 574 communicates at its lower end with a radially inwardly extending flange 576 having a tapered upper annular shoulder 578 and a tapered lower annular shoulder 580 which communicates with the lower end face 568 of the top mandrel. The inner surface 582 of the inwardly extending flange 576 defines a non-circular, longitudinal passage extending through the flange 576. This configuration of the inner surface 582 permits non-rotating, longitudinally sliding engagement with the upper end portion 584 of the bottom mandrel 586 of the operating mandrel assembly 364.

The bottom mandrel 586 is a tubular member having an upper end face 588 which includes a tapered circumferential surface 590 which is engageable with the tapered annular shoulder 572 of the top mandrel 558. External thread 592 is formed on the substantially cylindrically shaped outer periphery of the bottom mandrel 586 and extends a substantial distance downwardly therefrom. A first cylindrical outer surface 594 extends downwardly from the external thread 592 and communicates with a radially outwardly extending flange 596 having upper and lower tapered circumferential shoulders 598 and 600 formed thereon. The external thread 592 is interrupted by a plurality of planar surfaces 602 aligned with the longitudinal axis of the bottom mandrel 586 and intersecting the upper end face 588 thereof and forming an extension on the upper end portion 584 having a non-circular horizontal cross-section conforming to the non-circular longitudinal inner surface 582 of the flange 576 of the top of the mandrel 558. The bottom mandrel 586 is preferably equipped with four planar surfaces 602 arranged to form a substantially square horizontal cross-section longitudinally slidably received within a substantially square opening formed in the flange 576 defined by the inner surface 582. It will be understood that other non-circular configurations may be employed to provide a non-rotating, longitudinally slidable relationship between the top and bottom mandrels 558 and 586.

A longitudinal groove 604 is formed in the external thread 592 and the cylindrical outer surface 594 of the bottom mandrel 586 and extends between one of the planar surfaces 602 and the outwardly extending flange 596. A spring thrust ring 606 is slidably disposed about the first cylindrical outer surface 594 and includes a lower end face 608 comprising inner and outer tapered annular surfaces 610 and 612. An inwardly extending pin 614 is formed on the spring thrust ring 606 and is received within the longitudinal groove 604 to prevent relative rotation between the spring thrust ring and the bottom mandrel 586. A compression coil spring 616 is disposed about the outer periphery of the bottom mandrel 586 and extends upwardly from the upper end face 618 of the spring thrust ring 606. The upper end of the compression coil spring 616 abuts the lower end face 620 of a spring adjustment nut 622 which is threadedly engaged with the external thread 592 of the bottom mandrel 586. A suitable amount of compressive preload is applied to the coil spring 616 by the spring adjustment nut 622. A lock screw 624 is threadedly engaged within the spring adjustment nut and is received within the longitudinal groove 604 to prevent rotational displacement of the nut on the external thread 592.

An external buttress thread 626 extends downwardly from the lower tapered shoulder 600 of the flange 596. The buttress thread 626 corresponds to and is threadedly engageable with the internal buttress thread 422 of the stop nut assembly 420 of the tubular housing assembly 362. A second cylindrical outer surface 628 extends downwardly from the buttress threads 626 and communicates with a radially outwardly extending circumferential rib 630. The rib 630 includes a tapered circumferential lower shoulder 632 which communicates with a third cylindrical outer surface 634 which extends downwardly therefrom. A circumferential recess 636 is formed in the cylindrical outer surface 634 and includes upper and lower tapered circumferential shoulders 638 and 640 communicating with the cylindrical outer surface 634. A cylindrical inner surface 642 extends the full length of the bottom mandrel 586 communicating between the upper end face 588 and the lower end face 644 thereof.

The operating mandrel assembly 364 further includes a tubular bottom cross-over nut 646 threadedly secured at the upper end portion 648 thereof to the lower end portion 650 of the bottom mandrel 586 and locked thereto by a threaded lock screw 651 extending through the bottom cross-over nut 646. The bottom cross-over nut 646 includes a radial upper end face 652 and a cylindrical outer surface 654 communicating therewith. A plurality of ports or openings 656 are formed in the medial portion of the bottom cross-over nut 646 providing communication between the interior and the exterior thereof. The lower end portion 658 of the bottom cross-over nut 646 preferably includes internal threads 660 formed therein.

Figure 3A:
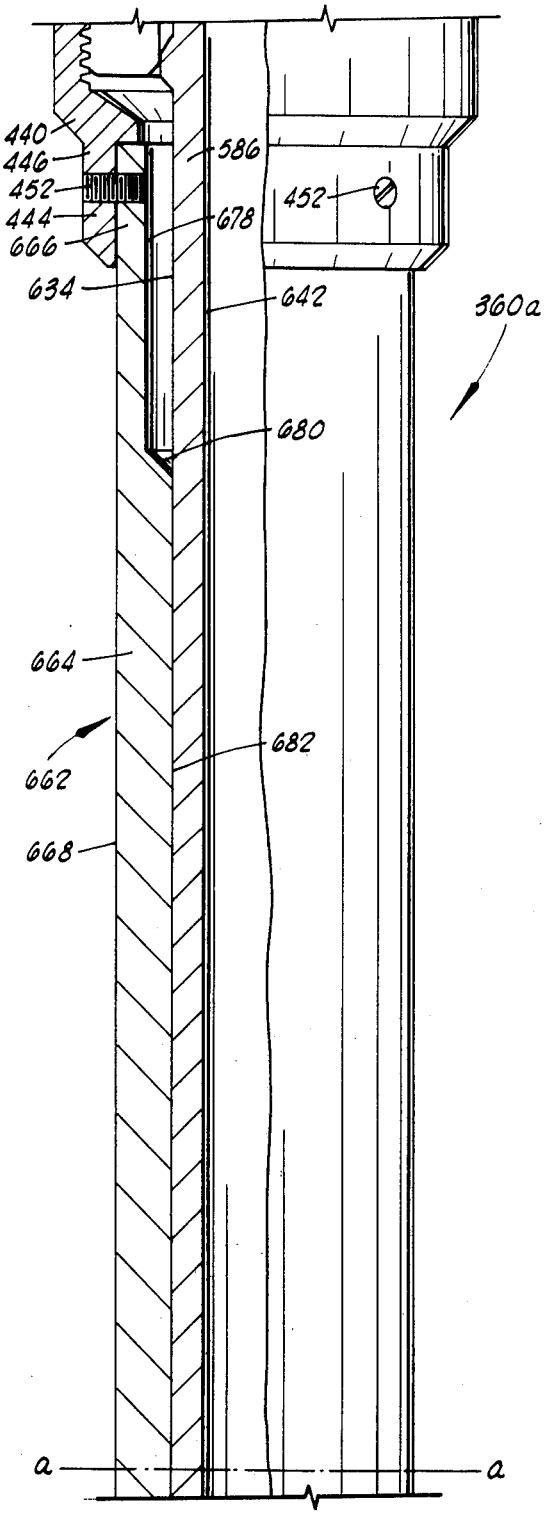
FIGS. 3A and 3B, joined alone line *a—a*, provide a partial vertical cross-sectional view of a retrieving tool employed with the apparatus of FIGS. 1A and 1B.
Figure 3B:
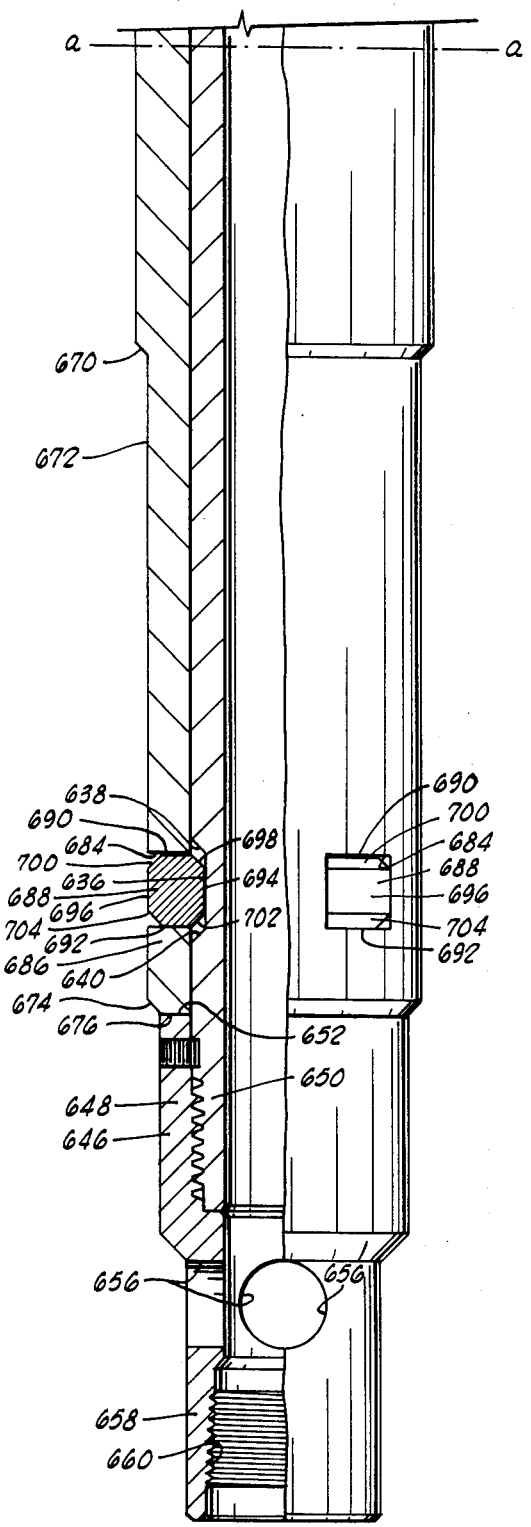

Referrng now to FIGS. 3A and 3B, there is shown a retrieving tool which is employed in retrieving the anchoring device 10 from a string of well pipe or casing in which the device has been completely latched and locked and vertification of the locking process has been obtained. The retrieval tool is a slightly modified version of the installing and actuating tool 360 and will be generally designated by the reference character 360a. Those elements in the tool 360a which are identical to the elements in the installing and actuating tool 360 will be identified by the same reference characters.

The retrieving tool 360a differs from the installing and actuating tool 360 in that a tubular releasing sleeve assembly 662 is substituted for the previously described setting sleeve assembly 366 and setting gage assembly 368. The releasing sleeve assembly 662 comprises a tubular releasing sleeve 664 releasably secured at the upper end portion 666 within the annular skirt 444 of the safety shear ring 440 by means of a plurality of safety shear screws 452 providing threaded mutual engagement therebetween. The releasing sleeve 664 includes a first cylindrical outer surface 668 extending downwardly from the upper end portion 666 thereof and communicating with a tapered circumferential shoulder 670 which in turn communicates with a second cylindrical outer surface 672. The cylindrical outer surface 672 extends downwardly from the shoulder 670 and communicates with the second tapered circumferential shoulder 674 which communicates with the lower end face 676 of the releasing sleeve 664.

A first cylindrical inner surface 678 is formed on the upper end portion 666 of the releasing sleeve 664 and extends downwardly to communicate with a tapered annular shoulder 680 which in turn communicates with a second cylindrical inner surface 682 which extends downwardly therefrom and communicates with the lower end face 676.

A plurality of radially aligned, circumferentially spaced release windows or openings 684 are formed in the lower end portion 686 of the releasing sleeve 664 and extend between the inner and outer cylindrical surfaces 682 and 672 thereof. The number of openings 684 formed in the releasing sleeve 664 will vary depending upon the diameter of the releasing sleeve 664, however, it is considered preferable to include at least six openings 684 in the releasing sleeve 664. A releasing dog 688 is received in each openings 684 and is adapted for radial movement therein. Radially outward movement of each dog 688 is positively limited by ears (not shown) formed thereon which are engageable with the releasing sleeve 664 adjacent the respective opening 684 in which the dog is received. Each releasing dog 688 includes an upper end face 690, a lower end face 692, a vertical inner surface 694 and a vertical outer surface 696. Inclined surfaces 698 and 700 communicate respectively between the upper end face 690 amd the inner and outer surfaces 694 and 696. Inclined surfaces 702 and 704 communicate respectively between the lower end face 692 and the inner and outer surfaces 694 and 696. It should be noted that the perpendicular distance between the inner and outer surfaces 694 and 696 of each of the releasing dogs 688 is substantially greater than the wall thickness of the releasing sleeve 664 between the inner and outer surfaces 682 and 672 thereof.

Figure 4A:
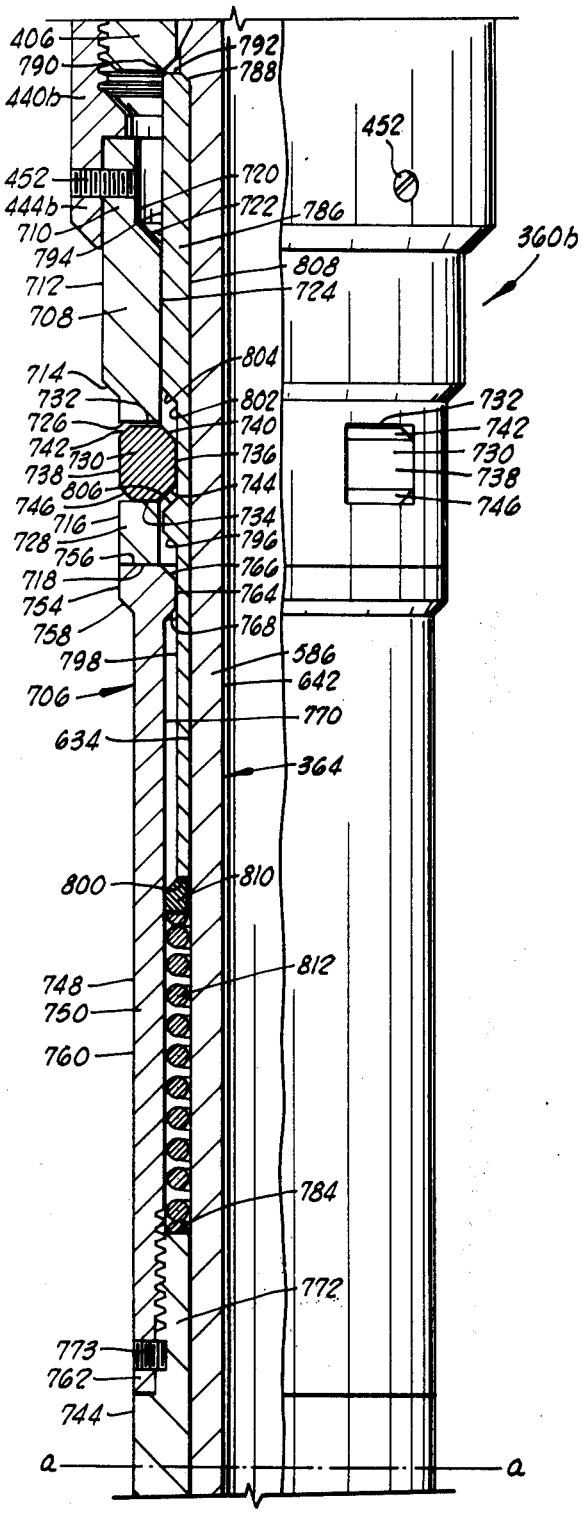
FIGS. 4A and 4B, joined along line *a—a*, provide a partial vertical cross-sectional view of an alternate form of retrieving tool employed with the apparatus of FIGS. 1A and 1B.
Figure 4B:
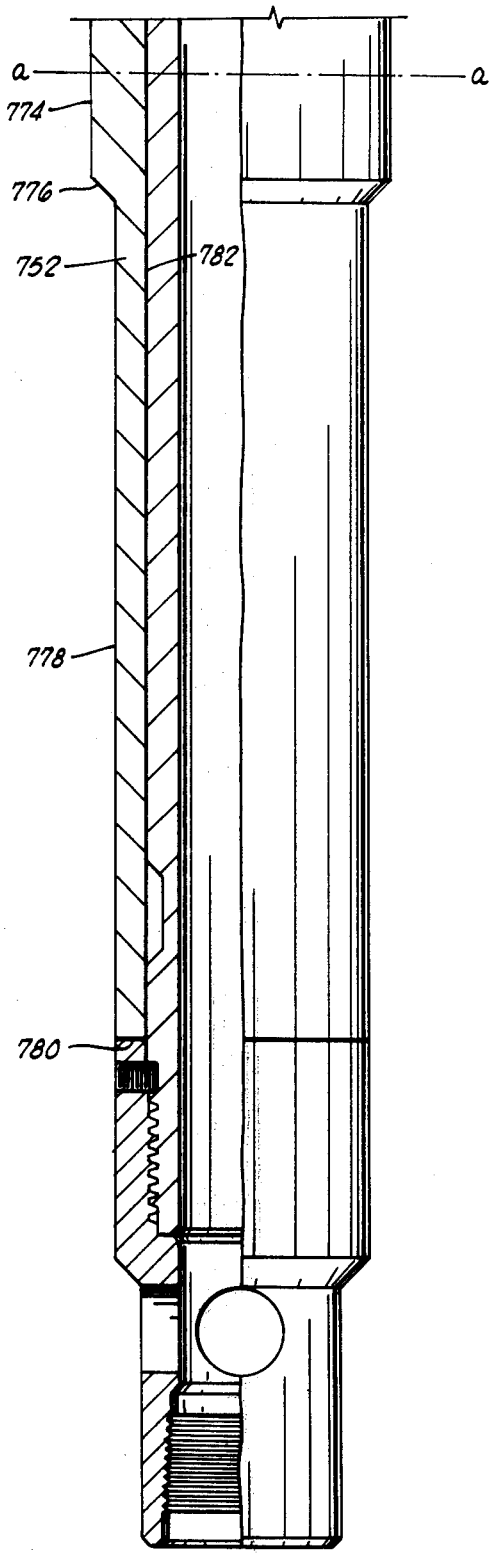
Figure 5:
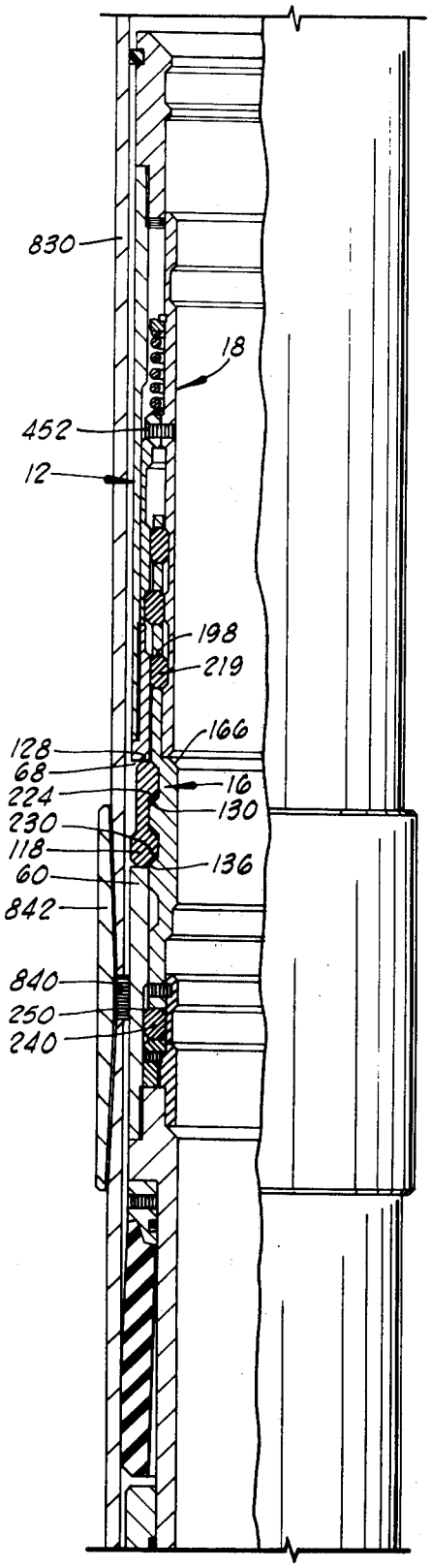
FIG. 5 is a partial vertical cross-sectional view illustrating the configuration of the anchoring device during insertion into a casing string with the installing and actuating tool omitted for clarity.

Referring now to FIGS. 4A and 4B, there is shown an alternate form of retrieving tool which is employed in retrieving the anchoring device 10 from a well pipe or casing when the anchoring device has been improperly latched therein and no verification of the latching and locking of the device has been obtained. Under such circumstances, it will be desirable to retrieve the anchoring device 10 from the string of well pipe or casing and re-anchor it therein with verification of the latching and locking of the device.

The retrieving tool of FIGS. 4A and 4B is a modification of the installing and actuating tool 360 and will be designated by the reference character **360*b*. Those elements common to the installing and actuating tool 360 and the retrieving tool 360*b* will retain the same reference characters. The retrieving tool 360*b* differs from the installing and actuating tool 360 in that a tubular retrieving assembly 706 is substituted for the previously described setting sleeve assembly 366 and setting gage sleeve assembly 368, and a slightly modified safety shear ring 440*b*, is substituted for the previously described safety shear ring 440. The difference between the modified safety shear ring 440*b* and the previously described safety shear ring 440 resides in the increased diameter of the annular skirt 444*b* of the modified safety shear ring 440*b*.**

The tubular retrieving assembly 706 includes a top retrieving sleeve 708 releasably secured at the upper end portion 710 thereof within the annular skirt **444*b* of the safety shear ring 440*b* by means of a plurality of safety shear screws 452 providing threaded mutual engagement between. A first cylindrical outer surface 712 is formed on the upper end portion 710 and extends downwardly to communicate with a tapered circumferential shoulder 714 which in turn communicates with a second cylindrical outer surface 716. The cylindrical outer surface 716 communicates with the lower end face 718 of the top retrieving sleeve 708. A first cylindrical inner surface 720 is formed within the upper end portion 710 of the top retrieving sleeve 708 and communicates with a tapered annular shoulder 722 which in turn communicates with a second cylindrical inner surface 724 which extends downwardly to communicate with the lower end face 718.**

A plurality of radially aligned, circumferentially spaced retrieving windows or openings 726 are formed in the lower end portion 728 of the top retrieving sleeve 708 adjacent the lower end face 718 thereof and extend between the inner and outer cylindrical surfaces 724 and 716. The number of windows or openings 726 formed in the top retrieving sleeve 708 will vary depending upon the diameter of the top retrieving sleeve, however, it is considered preferable to include at least six windows or openings 726 in the top retrieving sleeve 708. A retrieving dog 730 is received in each opening 726 of the top retrieving sleeve and is adapted for radial movement therein. Radially outward movement of each dog 730 is positively limited by ears (not shown) formed thereon which are engageable with the top retrieving sleeve 708 adjacent the respective opening 726 in which the dog is received. Each retrieving dog 730 includes an upper end face 732, a lower end face 734, a vertical inner surface 736 and a vertical outer surface 738. Inclined surfaces 740 and 742 communicate respectively between the upper end face 732 and the inner and outer surfaces 736 and 738. Inclined surfaces 744 and 746 communicate respectively between the lower end face 734 and the inner and outer surfaces 736 and 738. It should be noted that the perpendicular distance between the inner and outer surfaces 736 and 738 of each of the retrieving dogs 730 is substantially greater than the wall thickness of the top retrieving sleeve 708 between the inner and outer surfaces 724 and 716 thereof.

A tubular release sleeve assembly 748 is longitudinally slidably disposed about the bottom mandrel 586 of the operating mandrel assembly 364 and comprises a top release sleeve 750 and a bottom release sleeve 752. A first cylindrical outer surface 754 is formed on the top release sleeve 750 extending downwardly from the upper end face 756 to communicate with a tapered circumferential shoulder 758. A second cylindrical outer surface 760 extends downwardly from the circumferential shoulder 758 to the lower end portion 762 of the top release sleeve 750. A first cylindrical inner surface 764 communicates with the upper end face 756 via a tapered annular shoulder 766 and extends downwardly therefrom to communicate with a second tapered annular shoulder 768 which in turn communicates with a second cylindrical inner surface 770 which extends downwardly therefrom to the lower end portion 762.

The bottom release sleeve 752 is threadedly secured at its upper end portion 772 to the lower end portion 762 of the top release sleeve 750 and is locked thereto by a threaded safety lock screw 773 extending through the lower end portion 762 of the top release sleeve 750. A first cylindrical outer surface 774 is formed on the upper end portion 772 of the bottom release sleeve 752 and extends downwardly to communicate with a tapered circumferential shoulder 776 which in turn communicates with a second cylindrical outer surface 778 which extends downwardly to communicate with the lower end face 780 of the bottom release sleeve 752. A cylindrical inner surface 782 extends between the upper end face 784 and the lower end face 780 of the bottom release sleeve 752.

A tubular release sleeve spacer 786 is longitudinally slidably disposed about the bottom mandrel 586, above the bottom release sleeve 752. The tubular release sleeve spacer 786 includes a tapered annular surface 788 and a tapered circumferential surface 790 formed on the upper end face 792 thereof. A first cylindrical outer surface 794 extends downwardly from the tapered circumferential surface 790 communicating with a tapered circumferential shoulder 796 which in turn communicates with a second cylindrical outer surface 798 which communicates with the lower end face 800 of the release sleeve spacer 786. A circumferential recess 802 is formed in the first cylindrical outer surface 794 and includes upper and lower tapered circumferential shoulders 804 and 806 communicating with the cylindrical outer surface 794. A cylindrical inner surface 808 extends between the tapered annular surface 788 of the upper end face 792 and the lower end face 800. A release sleeve ring 810 is disposed about the bottom mandrel 586 abutting the lower end face 800 of the tubular release sleeve spacer 786. A compression coil spring 812 is disposed about the bottom mandrel 586 intermediate the upper end face 784 of the bottom release sleeve 752 and the release sleeve ring 810.

Referring now to FIGS. 12A and 12B, there is illustrated a modification to the anchoring device 10 wherein the bottom nut 98 is removed from the lower end portion 96 of the packer support housing member 80 and the upper end portion 814 of a suitable safety valve 816 is threadedly secured to the lower end portion 96 in substitution for the bottom nut 98. The safety valve 816 may suitably be of the type disclosed in my U.S. Pat. No. 3,902,523 entitled "SAFETY VALVE FOR FLUID CONDUITS" which patent is incorporated herein by reference. The safety valve includes a cylindrical housing 818 having flow ports 820 and pressure sensing ports 822 and 824 formed in the walls of the housing 818. A spring centralizer 826 is carried on the exterior of the housing 818 to center the safety valve 816 within a casing string.

OPERATION

Figure 13:
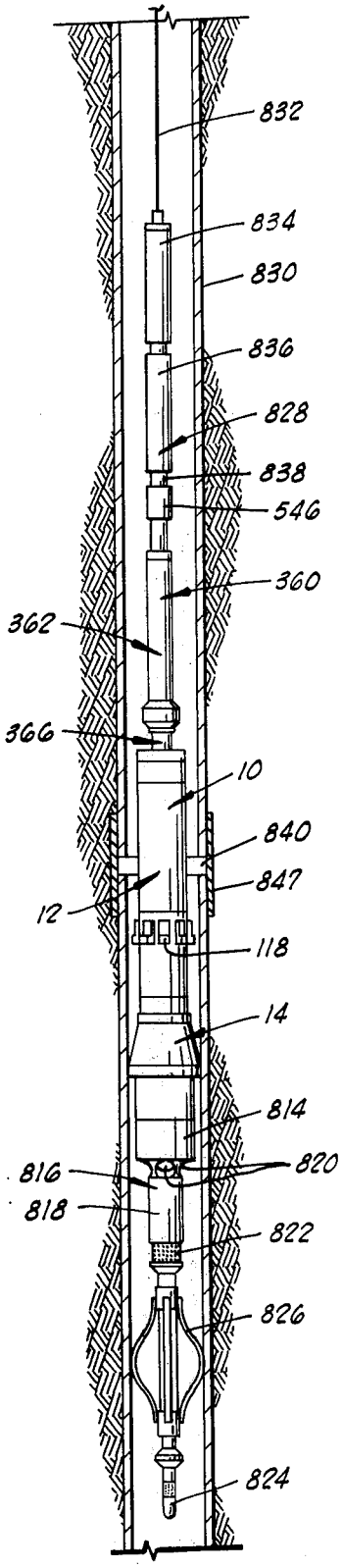
FIG. 13 is an elevational view of a typical string of tools for employment in conjunction with the anchoring device of the present invention disposed within a casing string.

Referring now to FIG. 13, there is shown a typical string of tools 828 for employment in anchoring the anchoring device 10 within a casing string 830. The tool string 828 is supported within the casing string 830 by a suitable conventional wire line 832. The wire line 832 is connected to a suitable conventional hydraulic jar 834 which may in turn be connected to a suitable conventional bumper 836. It may be advantageous to combine the structures of the hydraulic jar and bumper into a single unit to decrease the overall length of the tool string 828. It will be understood that such a tool string may be supported within the casing string on a string of drill pipe or tubing if desired.

The lower end portion 838 of the bumper 836 is threadedly secured within the internally threaded upper portion 548 of the top cross-over 546 of the installing and actuating tool 360.

Figure 6:
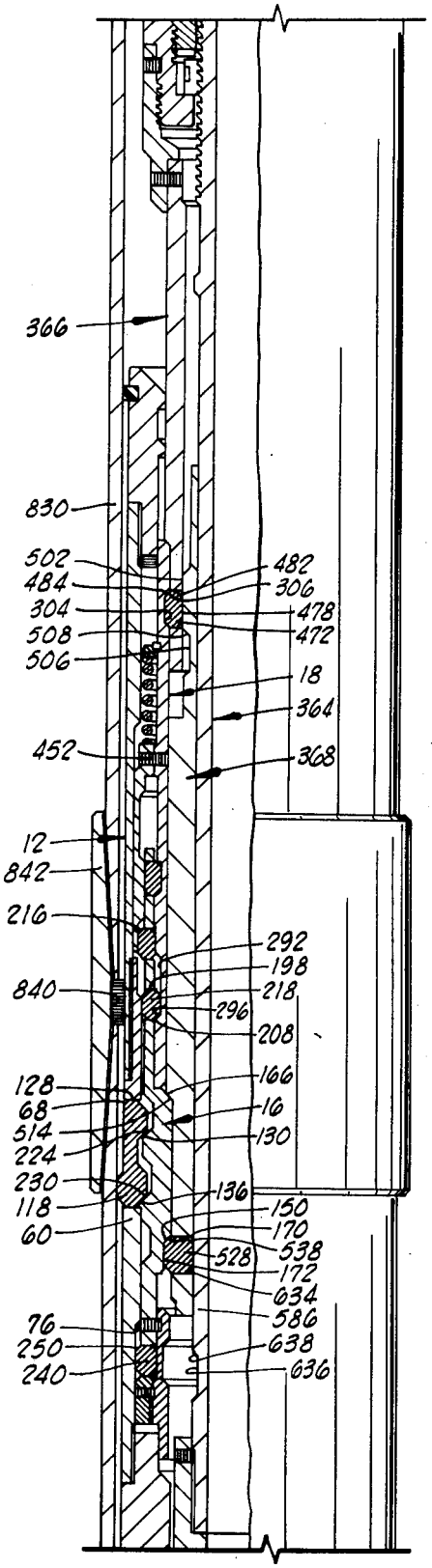
FIG. 6 is a partial vertical cross-sectional view, similar to FIG. 5, illustrating the anchoring device and installing and actuating tool during upward movement seeking a recess for anchoring in the casing string.

The installing and actuating tool 360 is initially secured within the anchoring device 10 as shown in FIG. 6 and as will be explained in greater detail hereinafter. The safety valve 816 is installed on the lower end of the anchoring device 10 to complete the tool string 828.

The casing string 830 includes an annular recess 840 formed in the inner surface thereof in which the anchoring device 10 will be set. The annular recess 840 may be formed by a standard API coupling 842 threadedly securing the adjacent end portions of casing pipe with a suitable longitudinal spacing between the adjacent end faces thereof. If desired, the annular recess may be formed within a conventional seating nipple which forms a part of the casing string.

As mentioned above, the installing and actuating tool 360 is initially secured within the anchoring device 10 at the ground surface in a manner as illustrated in FIG. 6. In FIG. 6 it will be seen that the setting sleeve assembly 366, the setting gage sleeve assembly 368 and the operating mandrel assembly 364 of the installing actuating tool 360 are inserted within the expansion sleeve 16 and setting sleeve 18 of the anchoring device 10. The installing and actuating tool 360 is initially inserted within the anchoring device 10 in the condition illustrated in FIGS. 2A, 2B, 2C and 2D with the operating mandrel assembly 364 in its uppermost position within the tubular housing assembly 362 until the tapered circumferential shoulder 456 of the setting sleeve assembly 366 abuts the tapered annular surface 300 at the upper end portion 278 of the setting sleeve 18. The setting sleeve 18 is prevented from moving downwardly within the tubular housing assembly 12 through its abutment at the lower end face 284 thereof with the annular shoulder 164 of the expansion sleeve 16 and the simultaneous abutment between the lower end face 160 of the expansion sleeve 16 and the upper end face 84 of the packer support housing member 80.

It will be noted at this point that the setting dogs 472 of the setting sleeve assembly 366 are radially aligned with the annular recess 304 of the setting sleeve 18. Sufficient downward force is then applied to the operating mandrel assembly 364 to force it downwardly within the tubular housing assembly 362 against the urging of compression coil spring 616. The buttress thread portion 626 of the operating mandrel assembly 364 passes downwardly through the snap nut assembly 420 overcoming the radially inward bias of the snap nut spring 430 on the nut segments 428. This downward movement of the operating mandrel assembly 364 causes the setting gage sleeve assembly 368 to move downwardly therewith through the engagement of the setting gage dogs 528 within the circumferential recess 636 in the operating mandrel assembly 364. The vertical outer surface 536 of each setting gage dog 528 bears against the second cylindrical inner surface 168 of the expansion sleeve 16 maintaining engagement between operating mandrel assembly and the setting gage sleeve assembly 368.

It will be seen that the downward movement of the setting gage sleeve assembly 368 with the operating mandrel assembly 364 relative to the setting sleeve assembly 366 causes the setting dogs 472 of the setting sleeve assembly 366 to be cammed radially outwardly into the annular recess 304 in the setting sleeve 18 through the sliding engagement between the upper tapered circumferential surface 508 of the circumferential recess 506 of the setting gage sleeve assembly 368 and the inclined surfaces 482 of the setting dogs 472. When the setting dogs 472 are fully cammed into the annular recess 304, the setting gage sleeve assembly 368 is free to slide downwardly relative to the setting sleeve assembly 366. The downward movement of the setting gage sleeve assembly 368 relative to the setting sleeve 18 and the expansion sleeve 16 continues until the tapered circumferential shoulder 514 of the setting gage sleeve assembly abuts the tapered annular shoulder 166 of the expansion sleeve 16 thereby terminating any additional downward movement of the setting gage sleeve assembly 368 within the anchoring device 10.

At this point the setting gage dogs 528 of the setting gage sleeve assembly 368 are positioned in radial alignment with the third cylindrical inner surface 172 of the expansion sleeve 16. Continued downward movement of the operating mandrel assembly 364 relative to the setting gage sleeve assembly 368 causes the setting gage dogs 528 to be cammed radially outwardly toward the third cylindrical inner surface 172 as a result of the sliding engagement between the upper tapered circumferential shoulder 638 of the circumferential recess 636 of the operating mandrel assembly 364 and the inclined surfaces 538 of the setting gage dogs 528. Continued downward movement of the operating mandrel assembly 364 locks the setting gage dogs 528 between the third cylindrical inner surface 172 and the third cylindrical outer surface 634 of the bottom mandrel 586 of the operating mandrel assembly 364. In this locked position, the setting gage dogs 528 prevent any upward movement of the setting gage sleeve assembly 368 relative to the expansion sleeve 16 through abutting engagement between the second tapered annular shoulder 170 of the expansion sleeve 16 and the inclined surfaces 540 of the setting gage dogs 528. Further downward movement of the operating mandrel assembly 364 relative to the tubular housing assembly 362 of the installing actuating tool 360 is positively limited by abutting engagement between the lower tapered shoulder 600 of the lower mandrel 586 and the tapered annular shoulder 398 of the tubular upper housing adapter 388. The operating mandrel assembly 364 is maintained in this locked condition through the locking mutual engagement between the snap nut assembly 420 and the buttress threads 626 formed on the lower mandrel 586.

Figure 7:
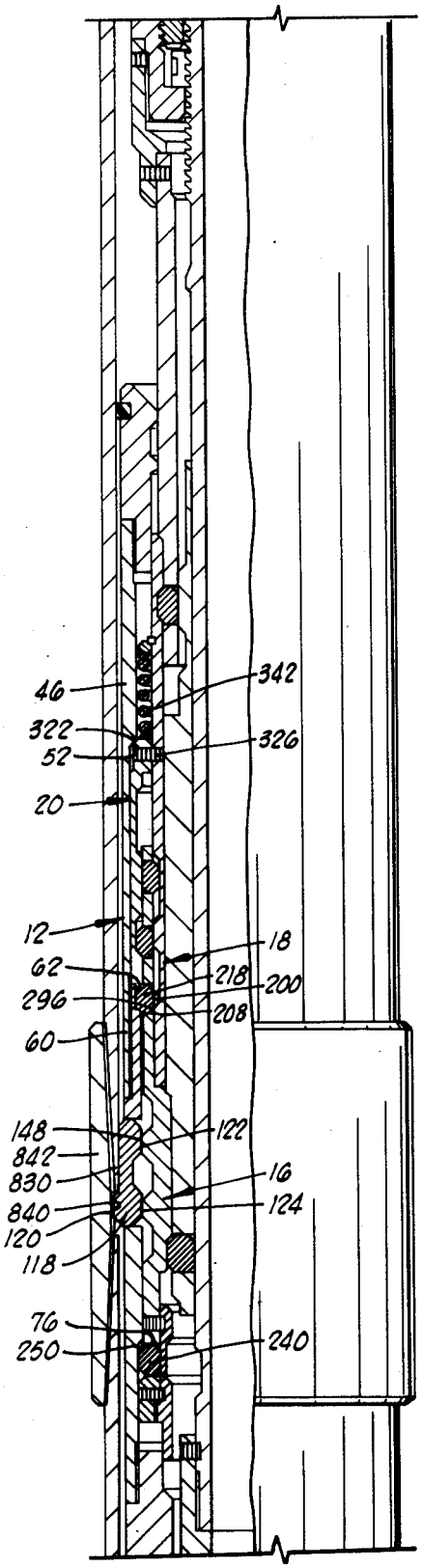
FIG. 7 is a partial vertical cross-sectional view, similar to FIG. 6, illustrating the anchoring device and installing and actuating tool with the anchoring device initially engaged in a recess in the casing string with the expansion sleeve in the process of latching prior to locking of the expansion sleeve.

It will be seen that with the elements of the installing and actuating tool 360 and the anchoring device 10 in the locked condition previously described, the installing and actuating tool 360 is securely attached within the anchoring device 10, as shown in FIG. 6, thus permitting the insertion of the tool string 828 within the casing string 830 and the subsequent movement of the tool string downwardly through the casing string to a position wherein the recess engaging dogs 118 of the anchoring device 10 are positioned below the annular recess 840 in the casing string 830. The anchoring device 10 is supported by the shear pins 326, as shown in FIG. 7, when the anchoring device is supported outside the casing string 830, and is supported as shown in FIG. 6 while within the casing string where the recess engaging dogs 118 cannot expand. The cross-overs 546 and 646 and hollow mandrel structure of the installing and actuating tool 360 provide a passage for pressure equalization of well fluids during insertion and retrieval of the anchoring device. An extension can be provided extending downwardly from the cross-over nut 646 to hold the safety valve 816 open for such pressure equalization during insertion and retrieval of the anchoring device.

In order to latch the anchoring device 10 in the annular recess 840 of the casing string 830, the wire line 832 is drawn upwardly through the casing string to apply lifting force to and raise the tool string 828 within the casing string 830. Lifting force is applied to the anchoring device 10 via the wire line 832, the hydraulic jar 834, bumper 836 and installing and actuating tool 360. The lifting force is applied through the installing and actuating tool 360 via the top cross-over 546 and top mandrel 558 into the tubular housing assembly 362 through abutting engagement between the tapered circumferential shoulder 564 of the top mandrel 558 and the tapered annular shoulder 378 of the upper housing member 370 of the housing assembly 362. The lifting force is applied from the tubular housing assembly 362 to the setting sleeve assembly 366 via the safety shear screws 452.

Lifting force is applied by the installing and actuating tool 360 to the anchoring device 10 through the setting dogs 472 of the setting sleeve assembly 366 to the setting sleeve 18 through engagement of the surfaces 484 of the dogs 472 with the upper tapered annular surface 306 of the annular recess 304 in the setting sleeve. The setting dogs 472 are maintained in such engagement by the cylindrical outer surface 502 of the setting gage sleeve assembly 368 in engagement with the inner surfaces 478 of the setting dogs 472 as illustrated in FIG. 6. The setting sleeve 18 applies force to the expansion sleeve 16 through the latch dogs 218 via the lower tapered circumferential shoulder 296 of the circumferential recess 292 of the setting sleeve 18, the inclined surfaces 208 of the latch dogs 218, the upper end faces 196 of the latch dogs 218 and the upper ends of the latch windows or openings 216 in the expansion sleeve 16.

Upward force from the expansion sleeve 16 is applied to the tubular housing assembly 12, casing packer assembly 14 and any additional structure secured to the tubular housing assembly via the recess dogs or slips 118. The tapered lower circumferential shoulders 224 and 230 of the expansion sleeve 16 respectively abuttingly engage the inclined surfaces 130 and 136 of the recess engaging dogs 118 and the upper end faces 128 of the recess engaging dogs 118 abuttingly engage the upper ends of the respective openings 68 in the latch mechanism housing member 60 of the tubular housing assembly 12. This engagement between the expansion sleeve 16 and the recess engaging dogs 118 simultaneously forces the recess engaging dogs 118 radially outwardly against the inner wall of the casing string 230 while applying lifting force to the tubular housing assembly 12 and other structure attached thereto.

As the tubular housing assembly 12 is moved upwardly within the casing string 830 in response to the application of lifting force thereto, it will be seen that the radially outward force applied to the recess engaging dogs 118 by the expansion sleeve 16 will move the shoulders 120 of the recess engaging dogs radially outwardly into the annular recess 840 in the casing string 830 when they become radially aligned as shown in FIG. 7. When the recess engaging dogs 118 move radially outwardly to engage the annular recess 840, the expansion sleeve 16 is released by the recess engaging dogs 118 and is permitted to move upwardly relative thereto in response to the continued lifting force applied by the wire line 832. The expansion sleeve 16 is permitted to move upwardly within the housing assembly 12 until the inclined surfaces 250 of the release dogs 240 abut the tapered annular shoulder 76 of the housing assembly 12 terminating any further upward movement of the expansion sleeve 16 relative to the tubular housing assembly 12. It will be seen that when the expansion sleeve 16 reaches the upward limit of its movement, the recess engaging dogs 118 are locked in their radially outwardly extended position through the abutting engagement between the shoulders 122 and 124 of the recess engaging dogs 118 and the cylindrical outer surface 148 of the expansion sleeve 16. It will also be seen that, as the expansion sleeve 16 approaches and reaches its full upward movement within the housing assembly 12, the latch dogs 218 become radially aligned with the first cylindrical inner surface 62 of the latch mechanism housing member 60 of the housing assembly 12. The latch dogs 218 are then forced radially outwardly toward the cylindrical surface 62 through the cam action sliding engagement between the lower tapered circumferential shoulder 296 of the setting sleeve 18 and the inclined surfaces 208 of the latch dogs 218 in response to continued upward force applied to the setting sleeve 18, as is illustrated in FIG. 7.

When the latch dogs 218 are fully cammed radially outwardly toward the cylindrical inner surface 62 of the housing assembly 12, the setting sleeve 18 is then released from engagement with the expansion sleeve 16 and is permitted to move upwardly relative to the expansion sleeve 16 in response to further upward force applied to the setting sleeve.

Figure 8:
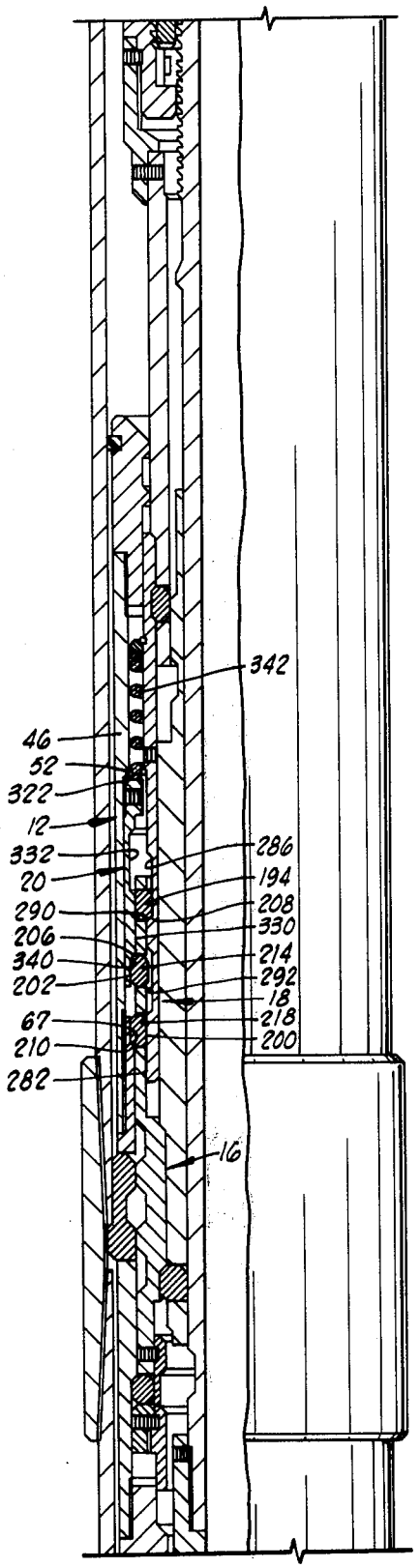
FIG. 8 is a partial vertical cross-sectional view, similar to FIG. 7, showing the expansion sleeve in the latched position and the lock sleeve released and in the process of locking the expansion sleeve in the latched position.

Subsequent to the initiation of the camming action of the setting sleeve 18 against the latch dogs 218 and prior to the release of the setting sleeve 18 by the latch dogs 218, the tapered circumferential surface 322 on the upper end portion of the lock sleeve 20 abuttingly engages the tapered annular shoulder 52 of the lock mechanism housing member 46 thus terminating any further upward movement of the lock sleeve 20 relative to the housing assembly 12, as shown in FIG. 7. Continued upward force applied to the setting sleeve 18 to complete the radially outward displacement of the latch dogs 218 toward the cylindrical inner surface 62 also causes the setting sleeve shear screws 326 securing the setting sleeve 18 to the lock sleeve 20 to part thereby allowing the lock sleeve compression coil spring 342 to force the lock sleeve 20 downwardly relative to the housing assembly 12 and the setting sleeve 18, as shown in FIG. 8. The upward force for shearing the shear screws 326 is usually applied by the hydraulic jar 834 when the anchoring device is run on a wire line thus permitting use of a small wire line without overlaoding.

Figure 9:
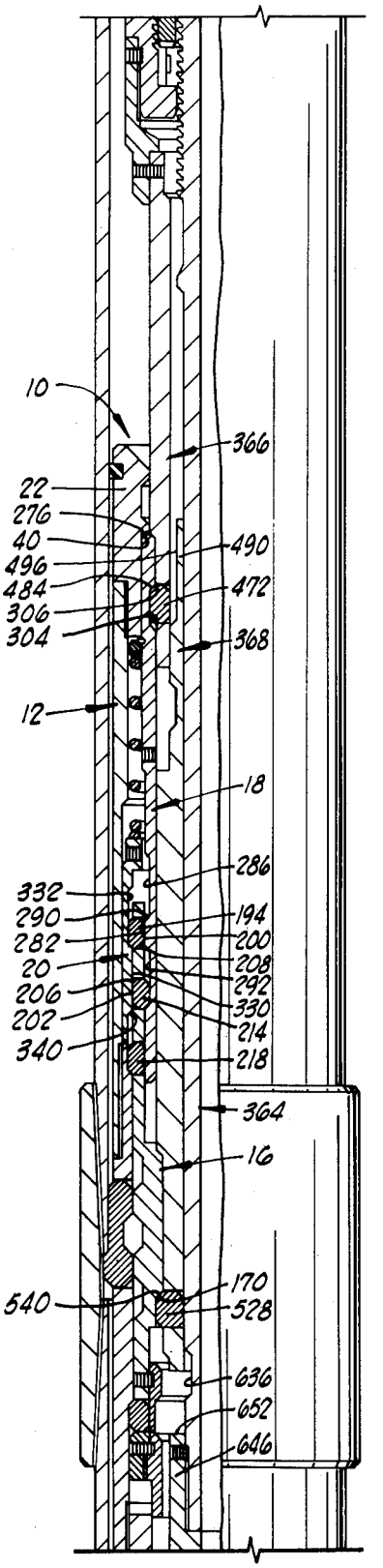
FIG. 9 is a partial vertical cross-sectional view, similar to FIG. 8, showing the lock sleeve in position to limit relative downward movement of the setting sleeve thereby locking the expansion sleeve in the latched position, and showing the setting sleeve in its full upward position releasing the setting sleeve assembly of the installing and actuating tool thus verifying locking of the expansion sleeve in the latched position.

It will be seen in FIG. 8 that as the latch dogs 218 are moved radially outwardly to release the setting sleeve 18 for further upward movement relative to the expansion sleeve 16, the expansion sleeve 16 is then prevented from moving downwardly relative to the housing assembly 12 by the abutting engagement between the tapered annular shoulder 67 of the housing assembly 12 and the inclined surfaces 210 of the latch dogs 218. The latch dogs 218 are maintained in position preventing downward movement of the expansion sleeve 16 through engagement between the second cylindrical outer surface 282 of the setting sleeve 18 and the vertical inner surfaces 200 of the latch dogs 218. When the latch dogs 218 are locked by the setting sleeve 18 and the lock sleeve 20 is released and forced downwardly by the lock sleeve compression coil spring 342, the lock dogs 214 are cammed radially inwardly into the second circumferential recess 292 of the setting sleeve 18 through the cam action between the tapered annular shoulder 340 of the lock sleeve 20 and the inclined surfaces 206 of the lock dogs 214. When the lock dogs 214 are fully cammed radially inwardly into the circumferential recess 292 by the lock sleeve 20 in response to the expansion of the lock sleeve compression coil spring 342, the lock dogs are maintained in this position through the engagement between the first cylindrical inner surface 330 of the lock sleeve 20 and the vertical outer surfaces 202 of the lock dogs 214, as shown in FIG. 9. The latch dogs 218 are locked by the lock dogs 214 which limit downward travel of the setting sleeve 18.

The downward movement of the lock sleeve 20 which secures the lock dogs 214 in their radially inward position, places the first annular recess 332 of the lock sleeve in radial alignment with the lock verification dogs 194. Continued upward movement of the setting sleeve 18 relative to the expansion sleeve 16 causes the lock verification dogs 194 to be cammed radially outwardly into the first annular recess 332 of the lock sleeve 20 through the camming action between the lower tapered circumferential shoulder 290 of the first circumferential recess 286 of the setting sleeve 18 and the inclined surfaces 208 of the lock verification dogs 194, as shown in FIGS. 8 and 9. The lock verification dogs 194 are maintained in their radially outwardly displaced position within the first annular recess 332 of the lock sleeve 20 through engagement between the second cylindrical outer surface 282 of the setting sleeve 18 and the vertical inner surfaces 200 of the lock verification dogs 194.

This last movement of the lock verification dogs 194 permits the setting sleeve 18 to freely move upwardly within the housing assembly 12 in response to upward force applied thereto through the setting sleeve assembly 366 and the setting dogs 472 until the upper end face 276 of the setting sleeve 18 abuts the annular shoulder 40 of the tubular top member 22 of the housing assembly 12. When the upward movement of the setting sleeve 18 within the housing assembly 12 is so terminated, it will be seen in FIG. 9 that the setting dogs 472 are then radially aligned with the first cylindrical outer surface 496 of the setting gage sleeve 490 of the setting gage sleeve assembly 368. Continued upward force applied to the setting sleeve assembly 366 by continued upward movement of the wire line 832 causes the setting dogs 472 to be cammed radially inwardly toward the first cylindrical outer surface 496 of the setting gage sleeve assembly 368 through the cam action and sliding engagement between the upper tapered annular surface 306 of the annular recess 304 in the setting sleeve 18 and the inclined surfaces 484 of the setting dogs 472. When the setting dogs 472 are fully displaced radially inwardly toward the cylindrical outer surface 496, the setting sleeve assembly 366 is then released from the anchoring device 10 and is free to move upwardly therefrom in response to further upward movement of the wire line 832.

After the release of the setting sleeve assembly 366 from engagement with the anchoring device 10, continued upward movement of the installing and actuating tool 360 relative to the anchoring device 10, which has caused continued upward movement of the operating mandrel assembly 364 therewith throughout the previously described operation steps, will cause further upward movement of the operating mandrel assembly 364 relative to the setting gage sleeve assembly 368 until the circumferential recess 636 of the operating mandrel assembly 364 is radially aligned with the setting gage dogs 528 and the upper end face 652 of the bottom cross-over nut 646 abuts the lower end face 522 of the setting gage sleeve 490 of the setting gage sleeve assembly 368. Additional upward force applied to the operating mandrel assembly 364 will cause the operating mandrel assembly 364 and the setting gage sleeve assembly 368 to move upwardly simultaneously relative to the anchoring device 10. Upon the upward movement of the setting gage sleeve assembly 368 with the operating mandrel assembly 364, the settng gage dogs 528 are cammed radially inwardly into the circumferential recess 636 of the operating mandrel assembly through the cam action engagement between the second tapered annular shoulder 170 of the expansion sleeve 16 and the inclined surfaces 540 of the setting gage dogs 528. The installing and actuating tool 360 is then fully released from the anchoring device 10 and may be retrieved to the ground surface along with the hydraulic jar 834 and bumper 836 of the tool string by the wire line 832 leaving the anchoring device 10 latched and locked in the annular recess 840 in the casing string 830.

Examination of the installing and actuating tool 360 at the ground surface after the previously described latching and locking of the anchoring device 10 in the annular recess 840 of the casing string 830 will reveal that the setting sleeve assembly 366 is still secured to the safety shear ring 440 of the tubular housing assembly 362 by the safety shear screws 452. By observing that the safety shear screws 452 are intact, it will be verified at the ground surface that the anchoring device 10 is securely latched in annular recess 840, and the latching mechanism is securely locked to prevent inadvertent release of the anchoring device 10 from the casing string 830.

When it is desired to release and retrieve the anchoring device 10 from its position latched and locked in the annular recess 840 of the casing string 830, after verification at the ground surface of such latched and locked condition, the retrieving tool **360*a*, described above and illustrated in FIG. 3, is substituted for the installing and actuating tool 360 in threaded engagement with the bumper 836 and is lowered downwardly through the casing string 830 on the wire line 832 along with the hydraulic jar 834. The retrieving tool 360*a* continues downwardly through the casing string 830 until the operating mandrel assembly 364 and tubular releasing sleeve assembly 662 are received within the anchoring device 10. Downward movement of the releasing sleeve assembly 662 relative to the anchoring device 10 terminates when the tapered circumferential shoulder 670 of the releasing sleeve 664 abuts the tapered annular shoulder 166 of the expansion sleeve 16. At this point it will be seen that the releasing dogs 688 of the releasing sleeve assembly 662 are radially aligned with the second cylindrical inner surface 262 of the tubular release sleeve 252.**

Additional downward force is then applied to the operating mandrel assembly 364 by the bumper 836 and the hydraulic jar 834 to drive the operating mandrel assembly 364 downwardly relative to the releasing sleeve assembly 662 and the tubular housing assembly 362 against the urging of the compression coil spring 616. The buttress thread portion 626 of the operating mandrel assembly 364 passes downwardly through the snap nut assembly 420 overcoming the radially inward bias of the snap nut spring 430 on the nut segments 428. This downward movement of the operating mandrel assembly 364 relative to the releasing sleeve assembly 662 causes the releasing dogs 688 of the releasing sleeve assembly 662 to be cammed radially outwardly toward the cylindrical inner surface 262 of the release sleeve 252 through the sliding engagement between the upper tapered circumferential shoulder 638 of the circumferential recess 636 of the operating mandrel assembly 364 and the inclined surfaces 698 of the releasing dogs 688. When the releasing dogs 688 are fully cammed into or near engagement with the cylindrical inner surface 262, the operating mandrel assembly 364 is free to move downwardly relative to the releasing sleeve assembly 662. Such continued downward movement of the operating mandrel assembly 364 locks the releasing dogs 688 between the second cylindrical inner surface 262 of the release sleeve 252 and the third cylindrical outer surface 634 of the bottom mandrel 586 of the operating mandrel assembly 364. In this locked position, the releasing dogs 688 prevent any upward movement of the releasing sleeve assembly 662 relative to the tubular release sleeve 252 through abutting engagement between the tapered annular shoulder 266 of the release sleeve 252 and the inclined surfaces 700 of the releasing dogs 688. Maximum downward movement of the operating mandrel assembly 364 relative to the tubular housing assembly 362 of the retrieving tool 360*a* is positively limited by abutting engagement between the lower tapered shoulder 600 of the lower mandrel 586 and the tapered annular shoulder 398 of the tubular upper housing adapter 388. The operating mandrel assembly 364 is maintained in this locked condition through the locking mutual engagement between the snap nut assembly 420 and the buttress threads 626 formed on the lower mandrel 586.

Figure 10:
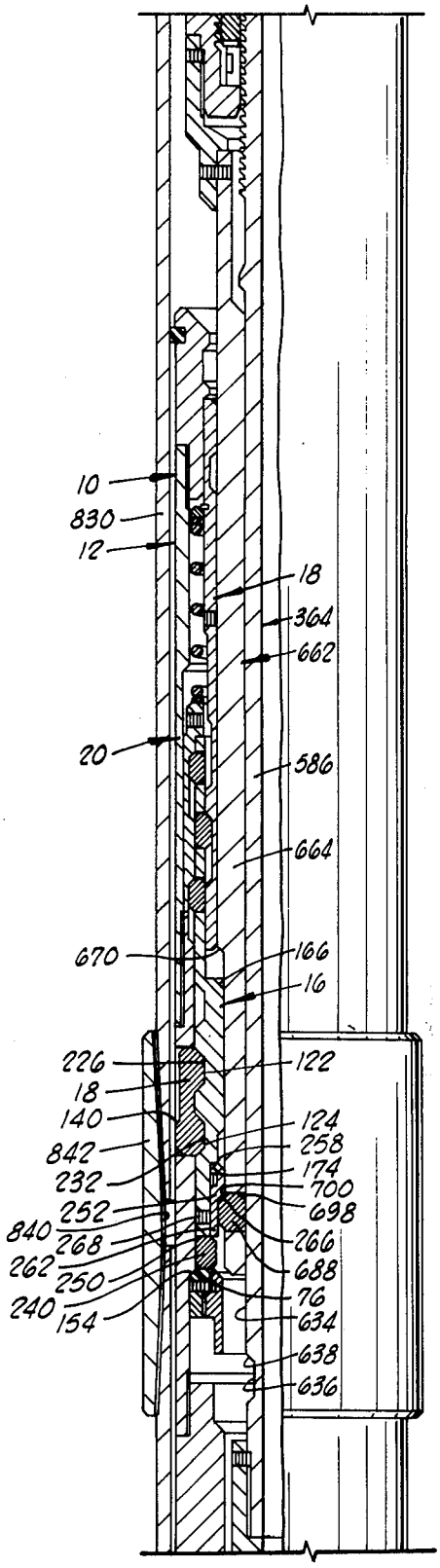
FIG. 10 is a partial vertical cross-sectional view illustrating the anchoring device engaged with the retrieving tool of FIGS. 3A and 3B in the process of releasing and retrieving the previously locked and verified anchoring device.

It will be seen that, with the elements of the retrieving tool 360*a* and the anchoring device 10 in the locked condition described above, the retrieving tool 360*a* is securely attached within the latched anchoring device 10 preparatory to release and retrieval of the anchoring device 10 from the casing string 830. To release and retrieve the latched anchoring device 10, upward force is applied to the wire line 832 to apply lifting force to the retrieving tool 360*a*. When sufficient lifting force is applied to the retrieving tool 360*a*, the release shear screws 268 securing the tubular release sleeve 252 to the expansion sleeve 16 are parted and the release sleeve 252 is moved upwardly relative to the expansion sleeve 16 until the upper end face 258 of the release sleeve 252 abuts the annular shoulder 174 of the expansion sleeve 16, as shown in FIG. 10. It may be necessary to use the hydraulic jar 834 to obtain sufficient force to shear the shear screws 268. This movement of the release sleeve 252 releases the release dogs 240 permitting them to be displaced radially inwardly toward the releasing sleeve assembly 662. Continued lifting force applied to the releasing sleeve assembly 662 is in turn applied to the expansion sleeve 16 through the releasing dogs 688 and the tubular release sleeve 252. In response to this lifting force, the expansion sleeve 16 moves upwardly within the tubular housing assembly 12 until the tapered circumferential shoulder 154 of the expansion sleeve abuts the tapered annular shoulder 76 of the housing assembly 12 thereby preventing any additional upward movement of the expansion sleeve 16 within the housing assembly 12. The release dogs 240 are cammed radially inwardly as the expansion sleeve 16 moves upwardly relative to the housing assembly 12 through the sliding engagement between the tapered annular surface 76 of the housing assembly 12 and the inclined surfaces 250 of the release dogs 240.

As shown in FIG. 10, when the expansion sleeve 16 has moved to its uppermost position within the tubular housing assembly 12, the inwardly extending shoulders 122 and 124 of the recess engaging dogs 118 are radially aligned with the second and third circumferential recesses 226 and 232, respectively, of the expansion sleeve 16. As the expansion sleeve 16 and the tubular housing assembly 12 are urged upwardly by the lifting force imparted by the wire line 832, the recess engaging dogs 118 are urged radially inwardly through the sliding engagement between the uppermost annular shoulder of the annular recess 840 in the casing string 830 and the inclined surfaces 140 of the recess engaging dogs 118. When the recess engaging dogs 118 are cammed radially inwardly in this manner, the anchoring device 10 is then completely released from the casing string 830 and may be lifted therefrom by retrieving the wire line 832 upwardly through the casing string with the anchoring device 10 secured to the retrieving tool 360*a* as shown in FIG. 10. The anchoring device 10 can be removed from the tools 360, 260*a* or 260*b* at the surface by unscrewing the buttress thread by relative rotation of the tool mandrel and housing.

It will be readily apparent to those skilled in the art that instances will arise when the anchoring device 10 cannot be properly latched and locked in an annular recess in a casing string due to a number of possible reasons which may include foreign matter deposited within the annular recess in which the anchoring device is to be secured, deformed casing at the location where it is desired to secure the anchoring device, mechanical malfunctions of the anchoring device or the installing and actuating tool or both, or the like. Under these circumstances, it may appear at the ground surface that the anchoring device is being securely latched and locked in the desired annular recess within the casing string, when in fact the anchoring device is only partially achieving latched engagement in the annular recess. Since a partial engagement of the anchoring device in the casing string can be extremely hazardous in high pressure environments such as cased gas wells, it is essential to obtain verification at the ground surface that the anchoring device is securely latched and locked in the desired annular recess in the casing string.

As will be evident from the previously described steps performed in latching the anchoring device 10 in the annular recess 840 of the casing string 830, failure to fully displace the recess engaging dogs 118 radially outwardly to the maximum extent necessary to latch the radially outwardly extending shoulders 120 thereof in the annular recess 840 will prevent upward movement of the expansion sleeve 16 to the maximum extent possible within the housing assembly 12 with the release dogs 240 in abutting engagement with the annular shoulder 76 of the housing assembly 12. It will be seen that, if the expansion sleeve 16 fails to attain its full upward movement within the housing assembly 12, the latch dogs 218 cannot become radially aligned with the first cylindrical inner surface 62 of the latch mechanism housing member 60 of the housing assembly 12. As a result, the setting sleeve 18 is prevented from moving further upwardly within the housing assembly 12 by the latch dogs 218 which bear against the lower tapered circumferential shoulder 296 of the second circumferential recess 292 of the setting sleeve 18. Consequently, the setting sleeve 18 is prevented from achieving the position illustrated in FIG. 9 wherein the setting dogs 472 of the setting sleeve assembly 366 are radially aligned with the first cylindrical outer surface 496 of the setting gage sleeve assembly 368 thus permitting release of the tubular setting sleeve 448 of the setting sleeve assembly 366 from the anchoring device 10. Continued upward force applied through the wire line 832 to the installing and actuating tool 360 will then cause the safety shear screws 452, securing the setting sleeve 448 to the safety shear ring 440, to part. The safety shear screws 452 require approximately twice shearing force to part them as is required to part the shear screws 326.

The installing and actuating tool 360 may then be retrieved from the anchoring device 10 by raising the operating mandrel assembly 364 upwardly relative to the now separated setting sleeve assembly 366 until the setting dogs 472 are radially aligned with the circumferential recess 506 of the setting gage sleeve assembly 368. Continued upward force applied to the installing and actuating tool 360 by continued upward movement of the wire line 832 causes the setting dogs 472 to be cammed radially inwardly into the circumferential recess 506 of the setting gage sleeve assembly 368 through the cam action and sliding engagement between the upper tapered annular surface 306 of the annular recess 304 in the setting sleeve 18 and the inclined surfaces 484 of the setting digs 472. When the setting dogs 472 are fully displaced radially inwardly into the circumferential recess 506, the setting sleeve assembly 366 is then released from the anchoring device 10 and is free to move upwardly therefrom with the remainder of the installing and actuating tool 360 in response to further upward movement of the wire line 832.

Examination of the installing and actuating tool 360 at the ground surface, after the steps described immediately above, will reveal that the setting sleeve assembly 366 has separated from the safety shear ring 440 of the tubular housing assembly 362. By observing that the safety shear screws 452 have been parted, it will be discerned at the ground surface that the anchoring device 10 is not securely latched in the annular recess 840, and it will be necessary to retrieve the improperly set anchoring device 10 from the casing string.

When it is desired to release and retrieve the anchoring devive 10 from an improperly latched position in the casing string 830, after indication at the ground surface of such improperly latched condition, the retrieving tool **360*b*, described above and illustrated in FIGS. 4A and 4B, is substituted for the installing and actuating tool 360 in threaded engagement with the bumper 836 and is lowered downwardly through the casing string 830 on the wire line 832 along with the hydraulic jar 834. The retrieving tool 360*b* continues downwardly through the casing string 830 until the operating mandrel assembly 364 and tubular retrieving assembly 706 are received within the improperly latched anchoring device 10. Downward movement of the top retrieving sleeve 708 of the tubular retrieving assembly 706 relative to the housing assembly 12 of the anchoring device 10 is terminated by the abutting engagement between the tapered circumferential shoulder 714 of the top retrieving sleeve 708 and the tapered annular shoulder 30 of the tubular top member 22 of the housing assembly 12. It will be seen that the retrieving dogs 730 are at this time radially aligned with the annular recess 34 of the tubular top member 22**.

Additional downward force is then applied to the operating mandrel assembly 364 by the bumper 836 and the hydraulic jar 834 to drive the operating mandrel assembly 364 downwardly relative to the tubular retrieving assembly 706 and the tubular housing assembly 362 against the urging of the compression coil spring 616. The buttress thread portion 626 of the operating mandrel assembly 364 passes downwardly through the snap nut assembly 420 overcoming the radially inward bias of the snap nut spring 430 on the nut segments 428. This downward movement of the operating mandrel assembly 364 relative to the retrieving assembly 706 causes downward movement of the tubular release sleeve spacer 786 through abutting engagement between the circumferential shoulder 632 of the circumferential rib 630 of the bottom mandrel 586 and the tapered annular surface 788 formed on the upper end face 792 of the release sleeve spacer 786. This downward movement of the release sleeve spacer 786 along with the operating mandrel assembly 364 relative to the top retrieving sleeve 708 causes the retrieving dogs 730 of the retrieving assembly 706 to be cammed radially outwardly into the annular recess 34 of the tubular housing assembly 12 through the sliding engagement between the upper tapered circumferential shoulder 804 of the circumferential recess 802 of the release sleeve spacer 786 and the inclined surfaces 740 of the retrieving dogs 730. When the retrieving dogs 730 are fully cammed into the annular recess 34, the operating mandrel assembly 364 and the release sleeve spacer 786 are free to move downwardly relative to the top retrieving sleeve 708 of the retrieving assembly 706. Such continued downward movement of the release sleeve spacer 786 locks the retrieving dogs 730 between the first cylindrical outer surface 794 of the release sleeve spacer 786 and the annular recess 34 of the tubular housing assembly 12. In this locked position, the retrieving dogs 730 provide secure connection between the retrieving tool **360*b* and the anchoring device 10 for subsequent retrieval of the anchoring device from the casing string 830**.

As the release sleeve spacer 786 continues its downward movement relative to the top retrieving sleeve 708 in response to the downward movement of the operating mandrel assembly 364, the tubular release assembly 748 is urged downwardly by the release sleeve spacer 786 through the compression coil spring 812, extending between the release sleeve spacer and the tubular release sleeve assembly. This downward movement of the tubular release sleeve assembly 748 continues in an unrestricted manner until the circumferential shoulder 758 of the top release sleeve 750 of the tubular release sleeve assembly 748 abuts the tapered annular surface 300 of the upper end portion 278 of the setting sleeve 18 of the anchoring device 10. The setting sleeve 18 is thereby moved downwardly within the housing assembly 12. If the setting sleeve 18 is lodged within the housing assembly 12 sufficiently securely to overcome the downward bias of the coil spring 812 acting between the release sleeve spacer 786 and the release sleeve assembly 748, the release sleeve spacer 786 will continue downwardly relative to the release sleeve assembly 748 until the tapered circumferential shoulder 796 of the release sleeve spacer 786 abuts the tapered annular shoulder 766 of the top release sleeve 750 thus providing a solid mechanical connection between the operating mandrel assembly 364 and the setting sleeve 18. Downward jarring shocks may be applied through the operating mandrel assembly 364 to the setting sleeve 18 through the action of the bumper 836 in a conventional manner until the setting 18 moves freely downwardly within the housing assembly 12.

The downward force resulting in the downward movement of the setting sleeve 18 within the housing assembly 12 is applied through the setting sleeve 18 directly to the expansion sleeve 16 through abutting engagement between the lower end face 284 of the setting sleeve 18 and the annular shoulder 164 of the expansion sleeve 16. The setting sleeve 18 and expansion sleeve 16 are moved downwardly within the housing assembly 12 by the operating mandrel assembly 364 until these elements assume their initial positions relative to the housing assembly 12 as shown in FIG. 11.

Figure 11:
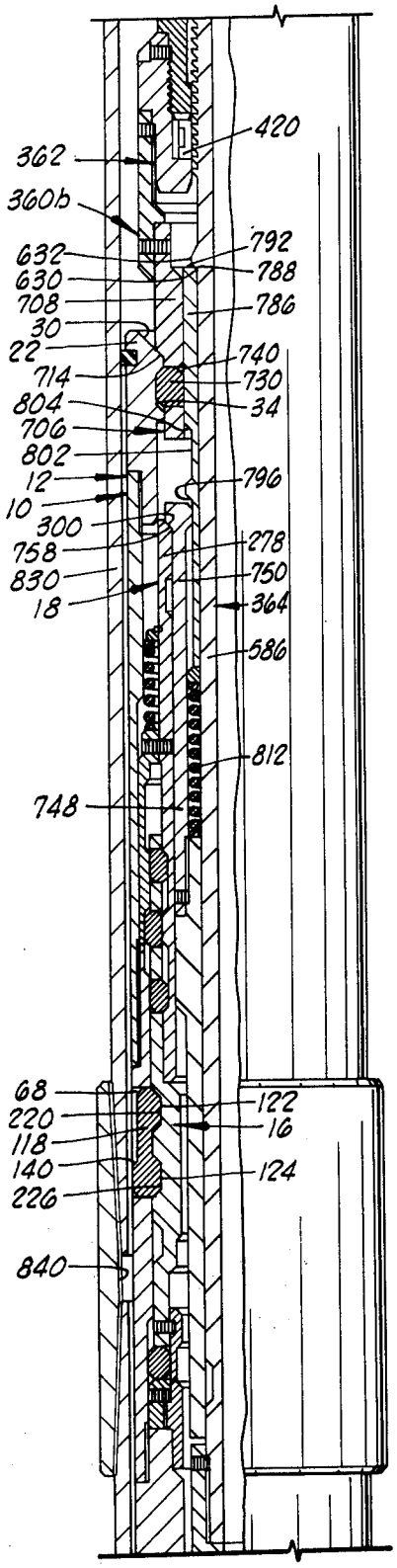
FIG. 11 is a partial vertical cross-sectional view illustrating the anchoring device engaged with the retrieving tool of FIGS. 4A and 4B in the process of releasing and retrieving the previously improperly latched, not locked and unverified anchoring device.

It will be seen in FIG. 11 that the expansion sleeve 16 is now positioned such that the circumferential recesses 220 and 226 thereof are radially aligned respectively with the inwardly extending shoulders 122 and 124 of the recess engaging dogs 118 thus permitting unrestricted inward movement of the recess engaging dogs 118 into the housing assembly 12.

With the downward movement of the operating mandrel assembly 364 within the tubular housing assembly 362 of the retrieving tool **360*b* terminated, as shown in FIG. 11, and with the operating mandrel assembly 364 securely locked in this position by the stop nut assembly 420, the anchoring device 10 is then prepared for retrieval from the casing string 830. Retrieval is achieved by raising the wire line 832 within the casing string 830 which in turn raises the hydraulic jar 834, bumper 836, retrieving tool 360*b* and anchoring device 10 upwardly through the casing string 830. The retrieving tool 360*b* is securely attached to the anchoring device 10 through the locked engagement between the retrieving dogs 730 of the retrieving assembly 706 and the tubular top member 22 of the tubular housing assembly 12. The recess engaging dogs 118 are cammed radially inwardly within their respective windows 68 as the anchoring device 10 moves upwardly through the sliding engagement between the uppermost annular shoulder of the annular recess 840 in the casing string 830 and the inclined surfaces 140 of the recess engaging dogs 118. When the recess engaging dogs 118 are cammed radially inwardly in this manner, the anchoring device 10 is then completely released from the casing string 830 permitting retrieval of the anchoring device 10 therefrom. The spring 812 maintains a downward biasing force on the setting sleeve 18 to prevent the dogs 118** from being inadvertently cammed outwardly to engage the casing string during retrieval.

Both retrieving tools **360*a* and 360*b* are equipped with safety shear release means to allow tool removal from the well if the anchoring device 10 becomes stuck too tight for normal removal methods. This capability permits killing the well and using drill pipe or tubing instead of wire line to provide greater force to remove the stuck anchoring device. The dust seal 102 is provided to prevent acculumation of debris outside the anchoring device 10** which could otherwise tend to cause the anchoring device to stick or make removal more difficult.

The foregoing discloses a novel form of anchoring device suitable for installation in well casing or the like for mounting suitable tools, such as flow control valves, within the casing through the utilization of a novel form of installing and actuating tool which provides visual verification at the ground surface of successful latching and locking of the anchoring device within the casing string. The foregoing further discloses novel retrieving tool structure for releasing and retrieving the anchoring device from the casing string after either proper or improper installation therein.

Changes may be made in the combination and arrangement of elements as heretofore set forth in the specification and shown in the drawings, it being understood that changes may be made in the embodiments disclosed without departing from the spirit and scope of the invention as defined in the following claims.

What is claimed is:

1. For use in pipe strings or the like having one or more annular recesses formed in the interior wall surfaces thereof, an anchoring device anchorable in a selected one of said recesses, comprising:

a tubular body insertable in the interior of a pipe string;

expansion sleeve means disposed within said tubular body for longitudinal movement relative thereto;

setting sleeve means disposed within said tubular body in longitudinal telescopic relation with said expansion sleeve means for longitudinal movement relative to said tubular body and to said expansion sleeve means;

lock sleeve means disposed within said tubular body releasably securable to said setting sleeve means and in longitudinal telescopic relation with said expansion sleeve means for longitudinal movement relative to said tubular body and to said expansion sleeve means;

biasing means operatively engaging said lock sleeve means for urging said lock sleeve means longitudinally toward said expansion sleeve means;

retainer means releasably securing said lock sleeve means to said setting sleeve means against the urging of said biasing means, said retainer means being releasable in response to predetermined longitudinal movement of said setting sleeve means relative to said tubular body;

at least one opening formed in the wall of said tubular body;

anchor member means disposed in said at least one opening for moving radially into and out of a selected one of said recesses;

inwardly projecting shoulder means formed on said anchor member means;

outwardly projecting enlargement means formed on said expansion sleeve means and movable therewith relative to said anchor member means between positions in and out of registration with said shoulder means for displacing said anchor member means radially outwardly into a selected one of said recesses to anchor said device and for releasing said anchor member means to permit radially inward retraction thereof from a selected one of said recesses in response to longitudinal movement of said expansion sleeve means relative to said tubular body;

latch member means carried by said expansion sleeve means and operatively engaging said setting sleeve means and said tubular body for latching said expansion sleeve means in position maintaining said anchoring member means in a selected one of said recesses in response to longitudinal movement of said setting sleeve means relative to said expansion sleeve means;

lock member means carried by said expansion sleeve means and operatively engaging said setting sleeve means and said lock sleeve means for locking said expansion sleeve means in position maintaining said anchor member means in a selected one of said recesses and preventing longitudinal movement of said expansion sleeve means relative to said tubular body in response to longitudinal movement of said setting sleeve means relative to said expansion sleeve means and to the release of said retainer means and longitudinal movement of said lock sleeve means relative to said expansion sleeve means under the urging of said biasing means; and verification member means carried by said expansion sleeve means and operatively engaging said setting sleeve means and said lock sleeve means for verifying the completion of the locking of said expansion sleeve means in position maintaining said anchor member means in a selected one of said recesses in response to additional longitudinal movement of said setting sleeve means relative to said expansion sleeve means.

2. The anchoring device as defined in claim 1 characterized further to include:

actuating means insertable in the interior of a pipe string from the ground surface for releasably engaging said setting sleeve means and said expansion sleeve means and applying upward longitudinal movement thereto relative to said tubular body to anchor said anchoring device in a selected one of said recesses.

3. The anchoring device as defined in claim 2 wherein said actuating means is characterized further to include:

means for automatically releasing said actuating means from said setting sleeve means and said expansion sleeve means upon the verification of the completion of the locking of said expansion sleeve means in position within said tubular body maintaining said anchor member means in a selected one of said recesses by said lock member means; and visual indication means for visually indicating at the ground surface verification of the completion of the locking of said expansion sleeve means.

4. The anchoring device as defined in claim 2 wherein said actuating means is characterized further to include:

means for automatically releasing said actuating means from said setting sleeve means and said expansion sleeve means in response to upward longitudinal movement of said actuating means relative to said tubular body; and visual indication means for providing a visual indication at the ground surface verifying the completion of the locking of said expansion sleeve means and, alternately, for providing a visual indication at the ground surface of a failure to complete the locking of said expansion sleeve means.

5. The anchoring device as defined in claim 2 characterized further to include:

retrieving means insertable in the interior of said pipe string from the ground surface for releasably engaging said anchored anchoring device in the pipe string, releasing said anchor member means from said pipe string and retrieving said anchoring device from said pipe string.

6. The anchoring device as defined in claim 2 characterized further to include:

retrieving means insertable in the interior of a pipe string from the ground surface for releasably engaging said anchored anchoring device having locked expansion sleeve means therein, releasing said expansion sleeve means and releasing said anchor member means from said pipe string and retrieving said anchoring device from said pipe string.

7. The anchoring device as defined in claim 2 characterized further to include:

actuating means insertable in the interior of a pipe string from the ground surface for releasably engaging said setting sleeve means and said expansion sleeve means and applying upward longitudinal movement thereto relative to said tubular body to anchor said anchor member means in a selected one of said recesses, said actuating means further including:

means for automatically releasing said actuating means from said setting sleeve means and said expansion sleeve means in response to upward longitudinal movement of said actuating means relative to said tubular body; and visual indication means for providing visual indication at the ground surface verifying the completion of the locking of said expansion sleeve means and, alternately, for providing a visual indication at the ground surface of a failure to complete the locking of said expansion sleeve means; and retrieving means insertable in the interior of said pipe string from the ground surface for releasably engaging said anchored device, releasing said anchor member means from said pipe string and retrieving said anchoring device from said pipe string.

8. The anchoring device as defined in claim 7 wherein said retrieving means is characterized further to include:

means. carried thereon for engaging an anchored anchoring device having locked expansion sleeve means therein, and releasing said anchor member means from said pipe string to permit retrieval of said anchoring device from said pipe string.

9. The anchoring device as defined in claim 7 wherein said retrieving means is characterized further to include:

means for engaging an anchored anchoring device in which said expansion sleeve means is incompletely locked therein, and releasing said anchor member means from said pipe string to permit retrieval of said anchoring device from said pipe string.

10. The anchoring device as defined in claim 1 characterized further to include:

packer means carried by said tubular body for providing sealing engagement between said tubular body and the interior wall surface of said pipe string.

11. The anchoring device as defined in claim 10 characterized further to include:

valve means carried by said tubular body for controlling fluid flow through said pipe string.

12. The anchoring device as defined in claim 1 characterized further to include:

packer means carried on the lower end portion of said tubular body for providing sealing engagement between said tubular body and the interior wall surface of a pipe string; and an annular seal member carried by said tubular body upwardly from said anchor member means for providing sealing engagement between said tubular body and the interior wall surface of said pipe string.

13. The anchoring device as defined in claim 1 characterized further to include:

release sleeve means disposed within said tubular body, releasably securable to said expansion sleeve means and in longitudinal telescopic relation with said expansion sleeve means for longitudinal upward movement relative to said expansion sleeve means;

stop member means carried by said expansion sleeve means and operatively engageable with said release sleeve means and said tubular body for stopping said expansion sleeve means in a position maintaining said anchoring member means in a selected one of said recesses in response to a first increment of upward longitudinal movement of said expansion sleeve means relative to said tubular body; and retainer means for releasably securing said release sleeve means to said expansion sleeve means, said retainer means being releasable in response to a predetermined upward force applied to said release sleeve means.

14. For use in pipe strings or the like having longitudinally spaced annular recesses formed in the interior wall surfaces thereof, an anchoring device anchorable in a selected one of said recesses, comprising:

a tubular body insertable in the interior of a pipe string;

expansion sleeve means disposed within said tubular body for longitudinal movement relative thereto;

setting sleeve means disposed within said tubular body in longitudinal telescopic relation with said expansion sleeve means for longitudinal upward movement relative to said tubular body and to said expansion sleeve means;

lock sleeve means disposed within said tubular body, releasably securable to said setting sleeve means and in longitudinal telescopic relation with said expansion sleeve means for longitudinal movement relative to said tubular body and longitudinal downward movement relative to said expansion sleeve means;

biasing means operatively engaging said lock sleeve means for urging said lock sleeve means longitudinally downwardly toward said expansion sleeve means;

retainer means releasably securing said lock sleeve means to said setting sleeve means against the downward urging of said biasing means, said retainer means being releasable in response to predetermined longitudinal movement of said setting sleeve means relative to said tubular body;

a plurality of openings formed in the wall of said tubular body;

anchor member means disposed in said plurality of openings for moving radially into and out of a selected one of said recesses;

radially inwardly projecting shoulder means formed on said anchor member means;

radially outwardly projecting annular rib means formed on said expansion sleeve means and movable therewith relative to said anchor member means between positions in and out of registration with said shoulder means for displacing said anchor member means radially outwardly into a selected one of said recesses to anchor said device in response to a first increment of upward longitudinal movement of said expansion sleeve means relative to said tubular body and for releasing said anchor member means to permit radially inward retraction thereof from a selected one of said recesses in response to an additional increment of upward longitudinal movement of said expansion sleeve means relative to said tubular body;

latch member means carried by said expansion sleeve means and operatively engaging said setting sleeve means and said tubular body for latching said expansion sleeve means in position maintaining said anchoring member means in a selected one of said recesses in response to a first increment of upward longitudinal movement of said setting sleeve means relative to said expansion sleeve means;

lock member means carried by said expansion sleeve means and operatively engaging said setting sleeve means and said lock sleeve means for locking said expansion sleeve means in position maintaining said anchor member means in a selected one of said recesses and preventing downward longitudinal movement of said expansion sleeve means relative to said tubular body in response to a second increment of upward longitudinal movement of said setting sleeve means relative to said expansion sleeve means, and to the release of said retainer means and resulting downward longitudinal movement of said lock sleeve means relative to said expansion sleeve means under the urging of said biasing means; and verification member means carried by said expansion sleeve means and operatively engaging said setting sleeve means and said lock sleeve means for verifying the completion of the locking of said expansion sleeve means in position maintaining said anchor member means in a selected one of said recesses by said lock member means in response to a third increment of upward longitudinal movement of said setting sleeve means relative to said expansion sleeve means.

* * * * *

UNITED STATES PATENT OFFICE

CERTIFICATE OF CORRECTION

Patent No. 4,018,275 Dated April 19, 1977

Inventor(s) Robert T. Gaut

It is certified that error appears in the above-identified patent and that said Letters Patent are hereby corrected as shown below:

Column 6, line 43, "128" should be --138--.

Column 10, line 68, "392" should be --391--.

Column 11, line 16, "but" should be --nut--.

Column 11, line 33, "488" should be --388--.

Column 22, line 37, "overlaoding" should be --overloading--.

Column 23, line 67, "settng" should be --setting--.

Column 26, line 13, "260a" should be --360a--.

Column 26, line 14, "260b" should be --360b--.

Column 28, line 63, between "setting" and "18" there should be inserted the word --sleeve--.

Column 29, line 51, "acculumation" should be --accumulation--

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*